US007157842B2

(12) United States Patent
Yao

(10) Patent No.: US 7,157,842 B2
(45) Date of Patent: Jan. 2, 2007

(54) IMAGE DISPLAY MEDIUM RIBS, PRODUCTION PROCESS THEREOF, AND IMAGE DISPLAY MEDIUM USING THE RIBS

(75) Inventor: Kenji Yao, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 192 days.

(21) Appl. No.: 10/778,310

(22) Filed: Feb. 17, 2004

(65) Prior Publication Data

US 2004/0160187 A1 Aug. 19, 2004

(30) Foreign Application Priority Data

Feb. 18, 2003 (JP) ..... 2003-039360
Aug. 29, 2003 (JP) ..... 2003-307067

(51) Int. Cl.
*H01J 1/88* (2006.01)
*H01J 17/49* (2006.01)

(52) U.S. Cl. ..... 313/292; 313/582

(58) Field of Classification Search ..... 313/582–587, 313/292, 283, 495, 238
See application file for complete search history.

(56) References Cited

U.S. PATENT DOCUMENTS 5,723,945 A * 3/1998 Schermerhorn ..... 313/581
6,043,604 A * 3/2000 Horiuchi et al. ..... 313/582
6,140,759 A * 10/2000 Sreeram et al. ..... 313/493

FOREIGN PATENT DOCUMENTS

JP A 5-297810 11/1993
JP A 7-43692 2/1995
JP A 8-304805 11/1996

* cited by examiner

*Primary Examiner*—Joseph Williams
(74) *Attorney, Agent, or Firm*—Oliff & Berridge PLC

(57) ABSTRACT

Ribs for an image display medium, which ribs can be retained between a pair of substrates. These image display medium ribs are formed by liquid injection molding (LIM molding), utilizing a heat-curable epoxy resin. In addition, the image display medium ribs are formed so as to have a cell-form arrangement.

16 Claims, 16 Drawing Sheets

IMAGE DISPLAY MEDIUM RIBS, PRODUCTION PROCESS THEREOF, AND IMAGE DISPLAY MEDIUM USING THE RIBS

CROSS-REFERENCE TO RELATED APPLICATION

This application claims priority under 35USC 119 from Japanese Patent Application Nos. 2003-39360 and 2003-307067, the disclosures of which are incorporated by reference herein.

BACKGROUND OF THE INVENTION

1. Field of the Invention

The present invention relates to ribs for an image display medium, which are employed in, for example, a display such as a plasma display panel (PDP), an electroluminescent display element (EL) or the like or a particle driving-type image display medium such as electronic paper which employs an image display material with electrophoreticity, thermal rewritability, electrochromy or the like, or the like, and relates to a process for fabricating the ribs and to an image display medium which utilizes the ribs.

2. Description of the Related Art

Heretofore, ribs have often been utilized in the field of image display media. In plasma display panels (PDP) and electroluminescence (EL) displays, ribs are utilized for maintaining inter-substrate (electrode) gaps and preventing pixel smearing, and as fluorescent substance and luminescent substance coating surfaces. Further, in particle-driving type image display media such as electronic paper and the like, ribs are required for preventing particle sinkage.

For these ribs, stripe-form arrangements have been employed, in view of ease of fabrication. Specifically, the following processes have all been tried: a photolithography process for etching a dry film (a resist material) (Japanese Patent Application Laid-Open (JP-A) No. 7-43692); a sandblasting process utilizing a resist material (JP-A No. 5-297810); in view of recent concern for the environment, a process of screen printing which utilizes a printing ink, which does not produce waste (JP-A No. 8-304805); and the like.

The prior technologies described above are all for stripe-form ribs. However, pixels of many image display media are formed in grid patterns. Therefore, with regard to image quality, meaning prevention of light emission leakage, particle sinkage and lateral flows, it is desirable to form ribs so as to make a lattice-form arrangement or the like, for example, so as to make a cell-form arrangement in which each pixel is two-dimensionally enclosed by the ribs.

It is ideal for ribs to be in a cell-form arrangement including a lattice pattern, because strength for maintaining an inter-substrate (electrode) gap is improved, surface area for coating a fluorescent substance or luminescent substance can be made larger, brightness is improved, reductions in power consumption are enabled, and so forth.

With ribs in such a cell-form arrangement, an area of an image display surface that the ribs occupy is larger than with a stripe-form arrangement. Therefore, there is a problem in that an open area ratio of the image display medium is reduced. In order to solve this problem, it is necessary to make the ribs thinner.

However, with photolithography utilizing a dry film, because of exudation of an etching solvent, defects will occur frequently if the ribs are made thinner. Further, with a sandblasting process utilizing a resist material, if the ribs are made thinner, lateral impacts from blasting particles cannot be disregarded, and rib defects are likely to occur frequently.

Further yet, when making ribs narrower is attempted with screen printing utilizing printing ink, there is a problem with stripe-form ribs in that the ink sags and lower portions of the ribs are fatter. If production of cell-form ribs is attempted, the ink will amass at intersection points. As a result, the ribs will become higher just at the intersection points, and functionality of the ribs will be lost.

SUMMARY OF THE INVENTION

A theme of the present invention is to solve the problems with the conventional art and achieve the following object. Specifically, an object of the present invention is to provide ribs for an image display medium, which enable provision of a high-image quality image display medium with a cell-form arrangement, a narrow rib width and a high open area ratio, and a process for fabricating the ribs and a high-image quality image display medium which utilizes the ribs.

The problem described above is solved by the following:

A first aspect of the present invention is to provide ribs for an image display medium, which are retainable between a pair of substrates, which ribs have been formed by liquid injection molding (LIM molding) including the use of heat-curable epoxy resin and have been formed such that the ribs form a cell-form arrangement.

A base width of the ribs may be at least 5 μm and at most 200 μm and a ratio of a half-height width of the ribs to the base width of the ribs may be at least 0.1 and at most 0.7. A height of the ribs may be at least 50 μm and at most 1000 μm, and a spacing of the ribs may be at least 20 μm and at most 5000 μm. In case the ribs are formed with a sheet, a thickness of a base plate portion of the sheet may be at least 3 μm and at most 200 μm.

A viscosity at 25° C. of the heat-curable epoxy resin before curing may have been at least 0.1 Pa·s and at most 100 Pa·s. A Shore D hardness at 25° C. of the heat-curable epoxy resin after curing may be at least 1 and at most 100. Coloration may be black or colorless transparency with an overall light transmissivity of at least 70%.

Conditions of the liquid injection molding process (LIM molding) may feature an injection temperature of at most 40° C. and a mold temperature of at most 150° C. The ribs may be formed so as to form a lattice pattern.

A second aspect of the present invention is to provide an image display medium including: a pair of substrates; and ribs retained between the pair of substrates, which ribs have been formed by liquid injection molding (LIM molding) including the use of heat-curable epoxy resin and have been formed such that the ribs form a cell-form arrangement.

A base width of the ribs may be at least 5 μm and at most 200 μm and a ratio of a half-height width of the ribs to the base width of the ribs may be at least 0.1 and at most 0.7. A height of the ribs may be at least 50 μm and at most 1000 μm, and a spacing of the ribs may be at least 20 μm and at most 5000 μm. In case the ribs are formed with a sheet, a thickness of a base plate portion of the sheet may be at least 3 μm and at most 200 μm.

A viscosity at 25° C. of the heat-curable epoxy resin before curing may have been at least 0.1 Pa·s and at most 100 Pa·s. A Shore D hardness at 250° C. of the heat-curable epoxy resin after curing may be at least 1 and at most 100. A color of the ribs may be black or colorless transparency with an overall light transmissivity of at least 70%.

Conditions of the liquid injection molding process (LIM molding) may feature an injection temperature of at most 40° C. and a mold temperature of at most 150° C.

The image display medium may be a luminescent substance or fluorescent substance coating-type image display medium. A luminescent substance or a fluorescent substance is coated on a surface at which the ribs are disposed.

The image display medium may be a particle driving-type image display medium, in which particles for image display are charged between the pair of substrates. The ribs may be formed so as to form a lattice pattern.

A third aspect of the present invention is to provide a process for fabricating ribs for an image display medium, which are retainable between a pair of substrates. The process includes: preparing a heat-curable epoxy resin; preparing a mold including a form corresponding to the ribs, such that the ribs form a cell-form arrangement; and forming the ribs with the heat-curable epoxy resin in the mold by a liquid injection molding process.

A viscosity at 25° C. of the heat-curable epoxy resin before curing may be at least 0.1 Pa·s and at most 100 Pa·s. A Shore D hardness at 25° C. of the heat-curable epoxy resin after curing may be at least 1 and at most 100.

Conditions of the liquid injection molding process (LIM molding) may feature an injection temperature of at most 40° C. and a mold temperature of at most 150° C. The ribs may be formed so as to form a lattice pattern.

According to the image display medium ribs and production process thereof of the present invention, an effect is achieved in that it is possible to provide a high-image quality image display medium with a cell-form arrangement, a narrow rib width and a high open area ratio.

Furthermore, according to the image display medium of the present invention, an effect is achieved in that high image quality can be realized by utilizing the image display medium ribs of the present invention.

DETAILED DESCRIPTION OF THE INVENTION

Figure 1B:
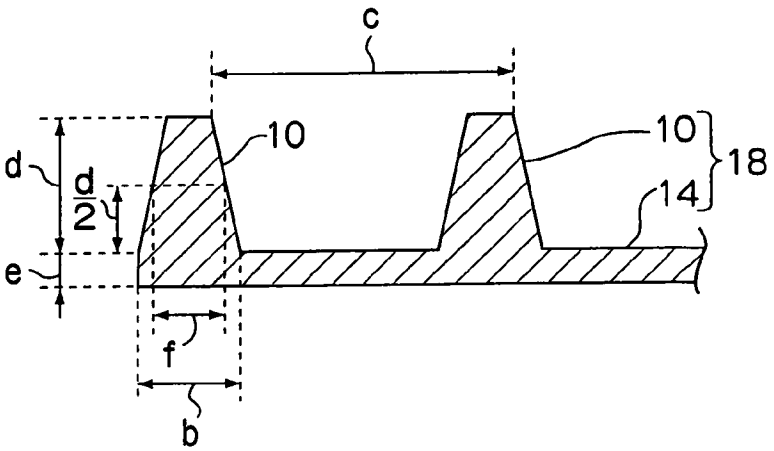
FIG. 1B is a sectional view cut along line 1—1 of FIG. 1A.

Ribs for an image display medium of the present invention are ribs which can be retained between a pair of substrates of an image display medium. The ribs are formed by liquid injection molding (LIM molding) using a heat-curable epoxy resin, and are formed such that the ribs form a cell-form arrangement.

Such heat-curable epoxy resins conventionally have a flowability that enables inflow into a mold corresponding to the form of the ribs, but releasability of such a resin from the mold is poor. However, by employing an LIM molding process, with the image display medium ribs of the present invention, defects are greatly suppressed, and structures with cell-form arrangements and narrow rib widths are formed.

In view of moldability and cost, the image display medium ribs are structured as a sheet with ribs, which includes a base plate portion and ribs that are formed protruding from the base plate portion integrally with the base plate portion. In the present invention, the ribs may be applied as such a ribbed sheet, and may be applied as separate ribs with the structure of a ribbed sheet from which the base plate portion has been removed. Hereafter in the present specification, the image display medium ribs are described as a ribbed sheet of the present invention.

The heat-curable epoxy resin is not particularly limited, and known heat-curable epoxy resins may be employed. For example, epoxy resins of main-chain polyester types, polycarbonate types, polyacrylate types, polystyrene types, polyamide types and the like may be used. Of these, polyester types are preferable in view of mechanical strength.

It is preferable if the heat-curable epoxy resin has a pre-curing viscosity at 25° C. of at least 0.1 Pa·s and at most 100 Pa·s, and it is more preferable if the same is at least 0.5 Pa·s and at most 70 Pa·s. If this value is less than 0.1 Pa·s, resin leakage will occur from even very small gaps in the mold, and molding defects such as flashing may occur. On the other hand, if the value exceeds 100 Pa·s, flowability will be insufficient, the resin will not circulate throughout the whole of the mold, and short shots may occur.

It is also preferable if the heat-curable epoxy resin has a post-curing Shore D hardness at 25° C. of at least 1 and at most 100, and it is particularly preferable if the same is at least 5 and at most 50. If this value is less than 1, mechanical strength of the ribs will be low, effectiveness for maintaining a gap may be reduced and endurance may be adversely affected. On the other hand, if the value is greater than 100, the ribs will be excessively hard, and separation from the mold may be troublesome.

With the ribbed sheet of the present invention, the arrangement of the ribs that are formed is a cell-form arrangement as viewed from a direction perpendicular to the base plate portion, and this is advantageous in regard to improving image quality of an image display medium in which the ribbed sheet is employed. As mentioned earlier, if ribs that are structured by a conventional dry film (resist material) or printing ink are set to a narrower rib width, many defects occur. In particular, if the ribs in such a case are set to a cell-form arrangement, defects are especially numerous. Therefore, with the present invention, it is a particularly great advantage that the ribbed sheet can have narrow rib widths and a cell-form arrangement. Moreover, not only are the rib widths made narrower, but the ribbed sheet has a smaller high-low difference of the ribs (a difference between heights of the largest ribs and heights of the smallest ribs).

A process for formation of the ribbed sheet of the present invention forms the ribbed sheet by liquid injection molding (LIM molding) using a heat-curable epoxy resin, This LIM molding, being liquid injection molding, is a process of injecting a material with extremely low viscosity and causing the material to flow in a mold, heat-curing the material inside the mold, and removing a molded item from the mold. As mentioned above, the heat-curable epoxy resin has flow characteristics that enable flow into a mold corresponding to the form of the ribs themselves, but inherent separability from the mold is poor. However, because the LIM molding process is employed, the heat-curable epoxy resin can be transferred to the mold and molded into the cell-form arrangement as is, volumes thereof are uniformly reduced by the thermosetting, and the resin can be separated from the mold. Thus, there is no necessity for further processes for forming the ribs, such as etching, sandblasting or the like, which are a cause of defects, and it is possible to form ribs with a cell-form arrangement and narrow rib widths with ease.

Accordingly, ribs for an image display medium can be fabricated by a process comprising: preparing a heat-curable epoxy resin; preparing a mold including a form corresponding to the ribs, such that the ribs form a cell-form arrangement; and forming the ribs with the heat-curable epoxy resin in the mold by a liquid injection molding process.

Now, because the cell-form arrangement of the ribs is an extremely fine structure, it is required that the resin has an extremely low viscosity during molding. Further, after molding, a certain amount of mechanical strength is required in regard to the function of maintaining an inter-substrate gap and to endurance. Therefore, it is extremely advantageous if the heat-curable epoxy resin that serves as the structural material of the ribbed sheet can have a high mechanical strength after curing, while having an extremely low viscosity in a state prior to curing. Further, considering the molding process, with usual injection molding, flow is excessive for handling such a low viscosity material, and amounts of resin supplied to the mold cannot be regulated. As a result, flash will occur on the molded item. Accordingly, it is extremely advantageous to use LIM molding, in which fixed amounts of the low viscosity material can be supplied, as the molding process.

As conditions during the LIM molding, an injection temperature of at most 40° C. and a mold temperature of at most 150° C. are preferable. If the injection temperature exceeds 40° C. or the molding temperature exceeds 150° C., it will take time for the ribbed sheet, which is the molded item, to cool down, a cycle time of the molding will be long, and productivity will tend to be lower.

Below, the ribbed sheet of the present invention will be described in more detail with reference to the drawings.

Figure 1A:
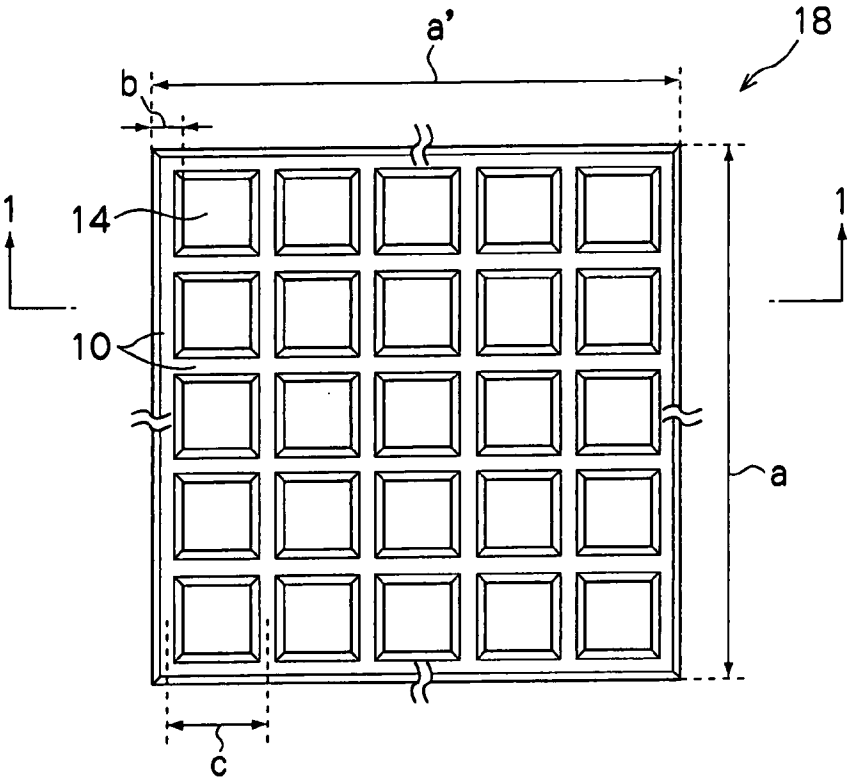
FIG. 1A is a plan view of a first example of a sheet with image display medium ribs of the present invention.
Figure 2B:
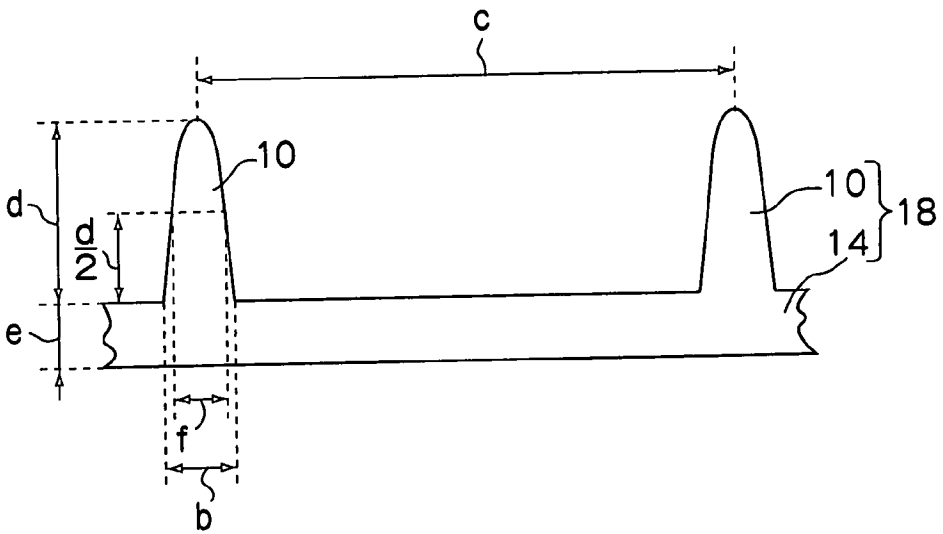
FIG. 2B is a sectional view cut along line 1—1 of FIG. 2A.
Figure 2A:
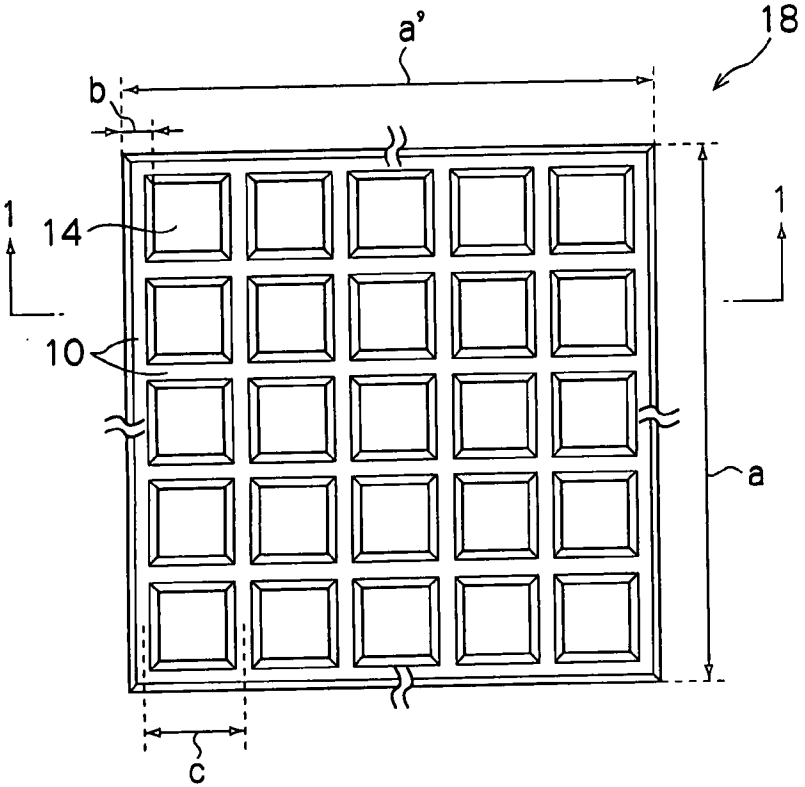
FIG. 2A is a plan view of a second example of a sheet with image display medium ribs of the present invention.
Figure 3B:
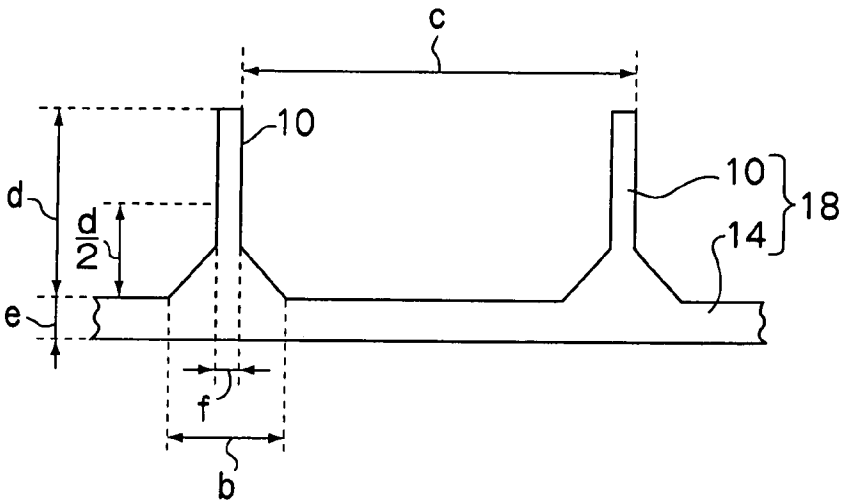
FIG. 3B is a sectional view cut along line 1—1 of FIG. 3A.
Figure 3A:
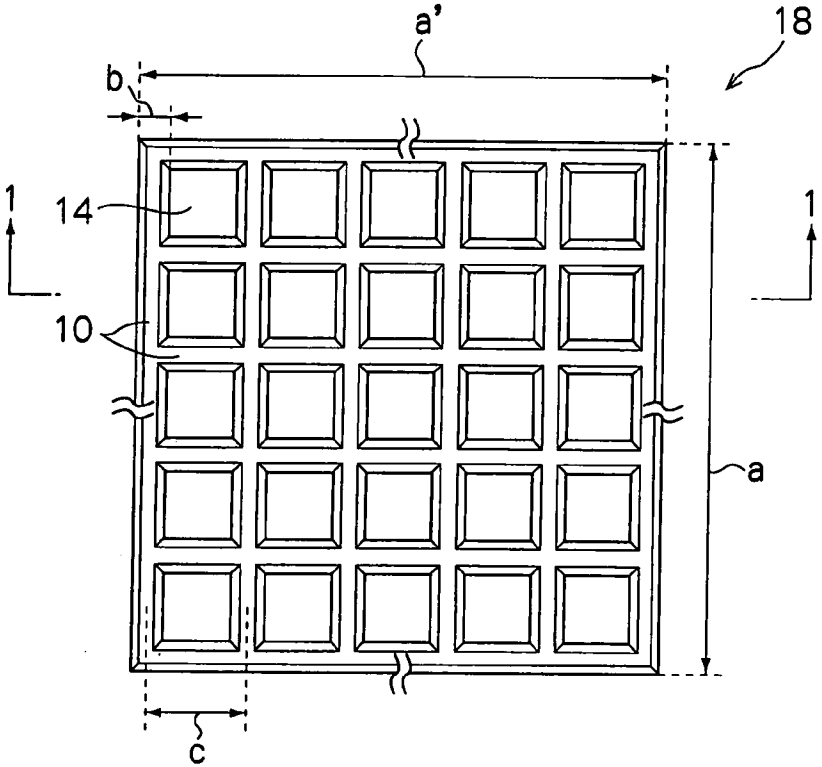
FIG. 3A is a plan view of a third example of a sheet with image display medium ribs of the present invention.

FIGS. 1A, 1B, 2A, 2B, 3A and 3B are examples of image display medium ribbed sheets of the present invention. FIGS. 1A, 2A and 3A are plan views, and FIGS. 1B, 2B and 3B are sectional views cut along lines 1—1 of FIGS. 1A, 2A and 3A, respectively. Ribbed sheets 18 shown in FIGS. 1A to 3B are structured by base plate portions 14 and cell-form arrangement ribs 10. The ribs 10 protrude from the base plate portions 14 and are formed integrally with the base plate portions 14. In the drawings, examples in which the cell-form arrangements surrounded by the ribs are square shapes in grid patterns are shown, but the present invention is by no means limited to this.

Herein, cell-form arrangements mean arrangements which are formed by divisions which are two-dimensionally enclosed by combinations of straight and/or curved ribs. Accordingly, the term lattice pattern includes, as is conventional, patterns in which edges that form a lattice are not disposed co-linearly (for example, a staggered pattern), patterns in which edges that form a lattice are disposed co-linearly only in a horizontal direction (one direction) (for example, a herringbone pattern), and the like. Further included are patterns in which divisions are two-dimensionally enclosed by polygons which are not simply rectangles (for example, a honeycomb pattern), patterns which are formed by divisions which are two-dimensionally enclosed by straight lines or curves, and patterns which are formed by divisions which are two-dimensionally enclosed by combinations thereof.

Anyway, in the drawings, a and a' represent a longitudinal width and lateral width, respectively, of the overall size of a ribbed sheet, b represents a width of rib base portions, c represents rib pitch (rib spacing), d represents rib height, e represents thickness of the base plate portion, and f represents a half-height width of the ribs. Here, the rib half-height width f represents a rib width at a position at 50% of the height d. Note that, in the present invention, these values represent values in a direction perpendicular to the base plate portion in sectional view.

The ribs 10 formed in this cell-form arrangement are structured by the heat-curable epoxy resin as described above. Therefore, as shown in FIGS. 1B, 2B and 3B, a fine arrangement, in which the base width b is at least 5 μm and at most 200 μm, and a ratio (f/b) of the rib half-height width f to the bottom width b is 0.7 or less, is possible.

It is preferable, in regard to image quality of an image display medium, that this rib base width is narrow, but it is also preferable that the rib base width b is broad in regard to mechanical strength. Accordingly, the rib base is at least 5 μm and at most 200 μm, more preferably at least 20 μm and at most 100 μm. If the rib base width b is less than 5 μm, mechanical strength is reduced, and functions of, for example, maintaining a gap and the like may not be achieved. On the other hand, if the rib base width b exceeds 200 μm, an effective area for application of a luminescent substance or fluorescent substance or for loading particles will inevitably be smaller, and applied voltages for image display will be harder to propagate, which are not preferable for image quality.

Further, in regard to releasability of the molded ribs from the mold and the open area ratio of display images, the value of the ratio (f/b) of the rib half-height width f to the rib base width b should be small, and it is preferable if this value is 0.7 or less. This value should also not be too small, in regard to intra-surface uniformity of applied voltages. Therefore, this value is preferably at least 0.1 and at most 0.7, and more preferably at least 0.3 and at most 0.6. If this value is less than 0.1, portions in which the angle of a rib slope is large will occur, which will lead to non-uniformity of applied voltages, and this may cause a decline in image quality. On the other hand, if this value is greater than 0.7, rib slopes will be inadequate, and separation from the mold may be extremely poor. Further, display side rib widths will be larger and the open area ratio of an image display medium will be lower, which will lead to a deterioration in image quality.

The rib height d and rib spacing c are not particularly limited, and can be suitably specified in accordance with applications. However, it is preferable if the rib height d is at least 50 μm and at most 1000 μm, and the rib spacing c is at least 20 μm and at most 5000 μm.

If the rib height d is less than 50 μm, an area for, for example, application of a fluorescent substance or luminescent substance may be insufficient or particle loading amounts may be insufficient, and this will lead to a reduction in image display quality. On the other hand, if the rib height d exceeds 1000 μm, an increase in application voltages, which is to say an increase in electricity consumption, may occur.

Furthermore, if the rib spacing c is less than 20 μm, even though the rib base width b is narrow, the lower open area ratio may be insufficient. On the other hand, if the rib spacing c exceeds 5000 μm, an area for, for example, application of a fluorescent substance or luminescent substance may be insufficient or particle loading amounts may be insufficient, and this will lead to a reduction in image display quality.

These values are more preferably a rib height d of at least 80 μm and at most 300 μm, a rib base width b of at least 30 μm and at most 100 μm, and a rib spacing c of at least 30 μm and at most 2000 μm.

The layer thickness e of the base plate portion 14 is also not particularly limited, but is preferably at least 3 μm and at most 200 μm, and particularly preferably at least 5 μm and at most 50 μm. If this value is less than 3 μm, however low the viscosity of the resin, it will be difficult to make the resin flow throughout the mold, and the size of the molded item will be limited to a small size.

Square lattice-form arrangements of ribs have been shown as representative examples of cell-form arrangements of the ribs. However, cell-form arrangements of the ribs may be, for example, as shown in FIGS. 4 to 11.

Figure 4:
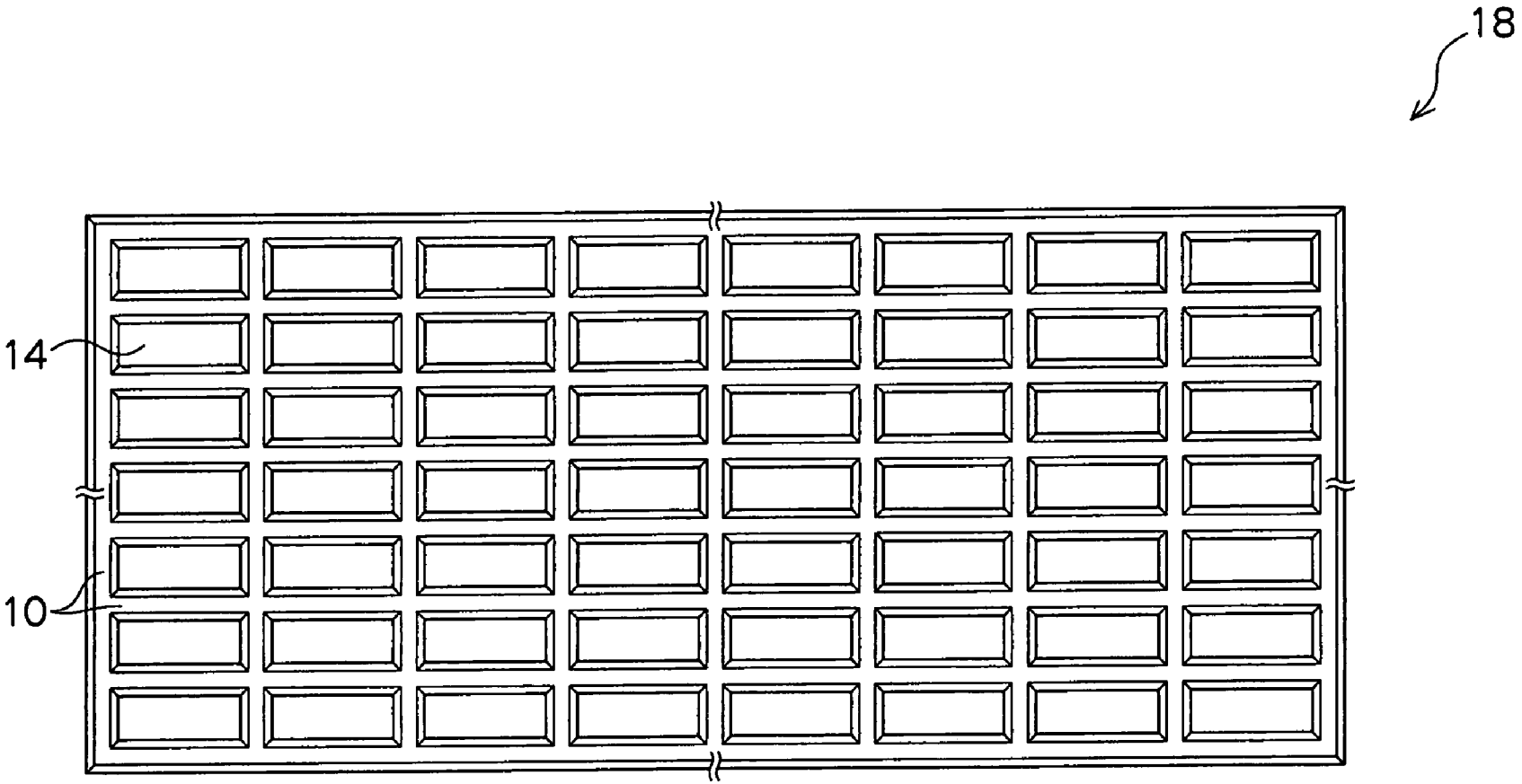
FIG. 4 is a plan view showing a fourth example of a sheet with image display medium ribs of the present invention.
Figure 5:
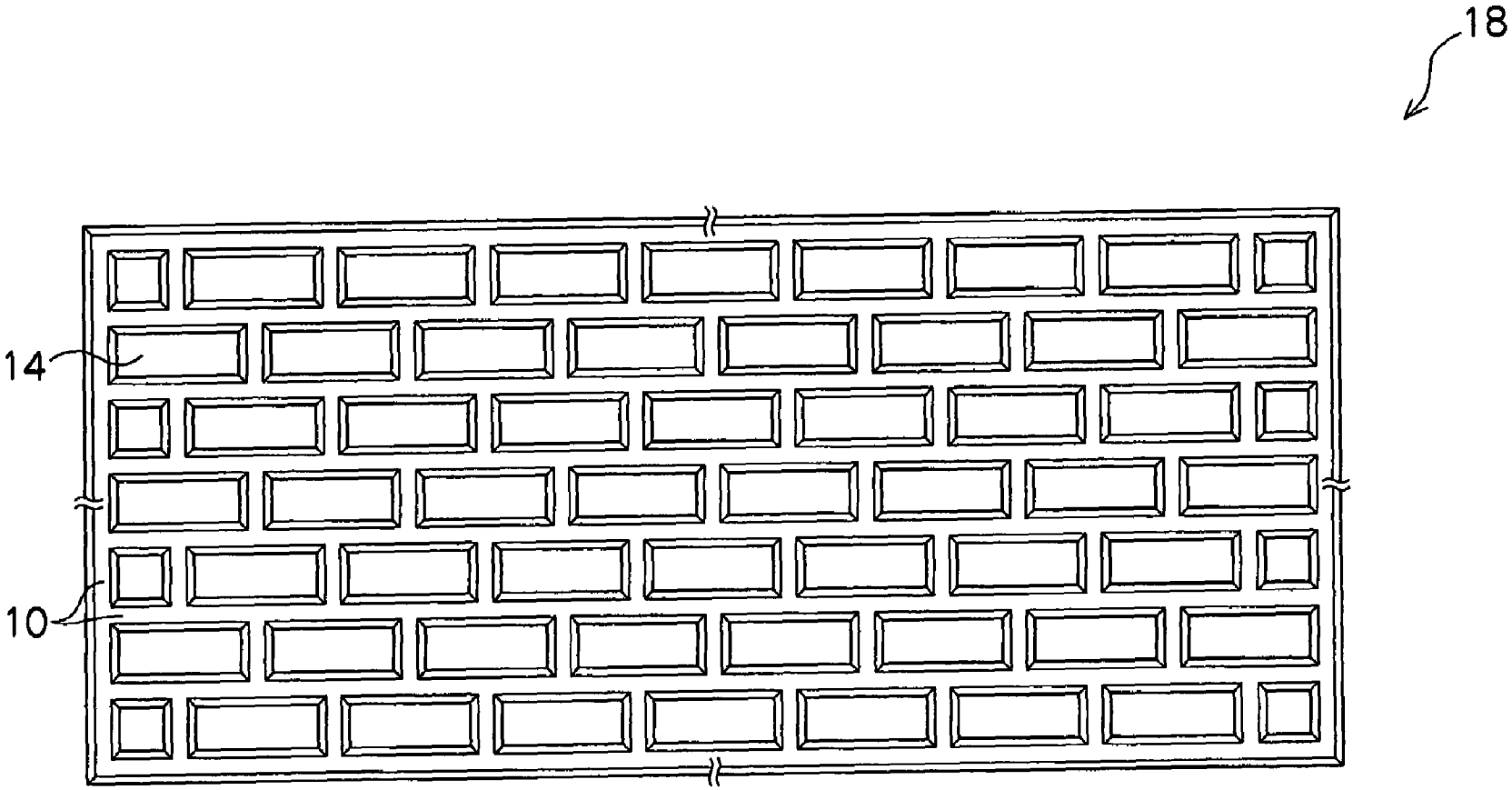
FIG. 5 is a plan view showing a fifth example of a sheet with image display medium ribs of the present invention.
Figure 6:
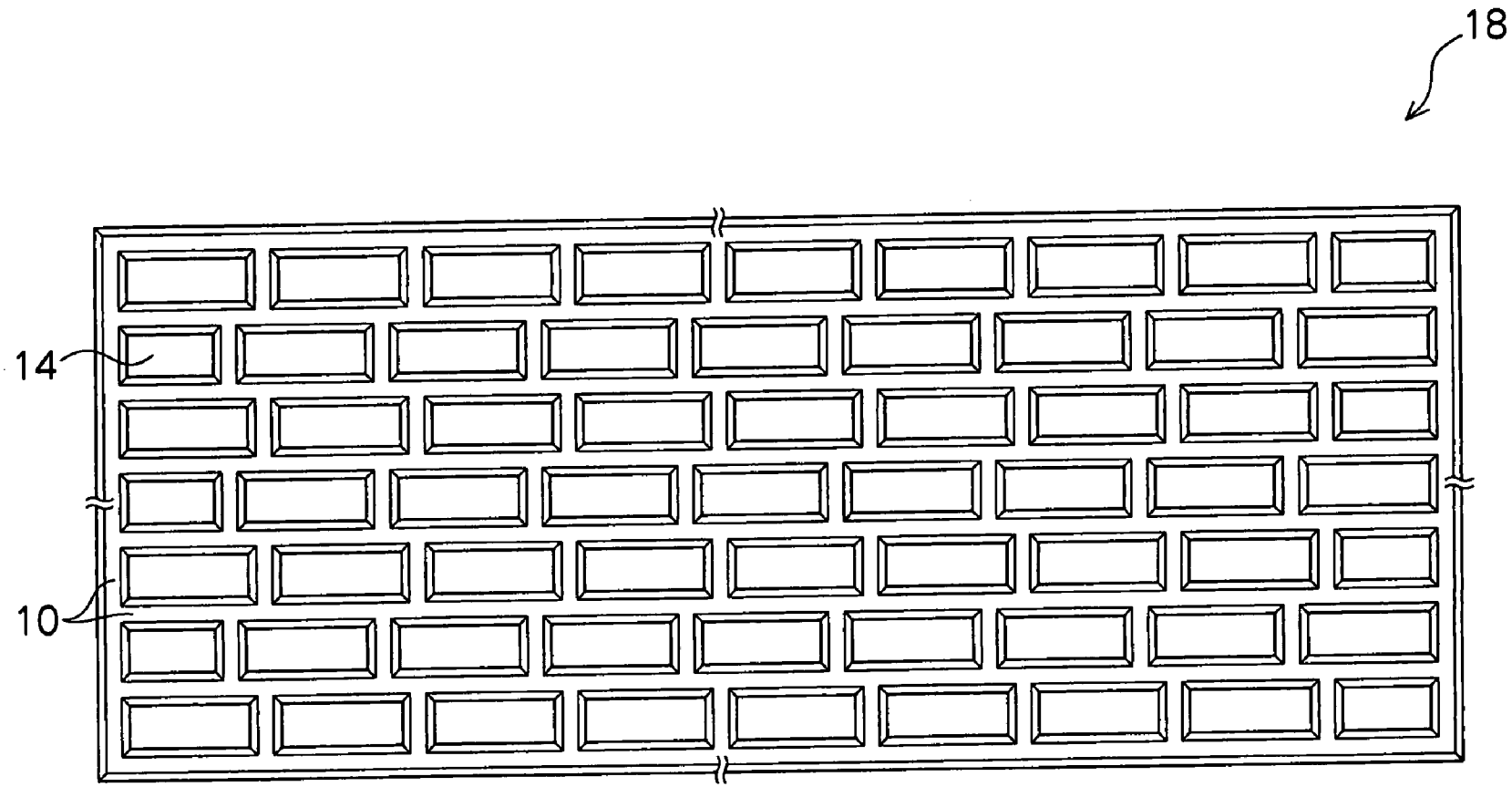
FIG. 6 is a plan view showing a sixth example of a sheet with image display medium ribs of the present invention.
Figure 7:
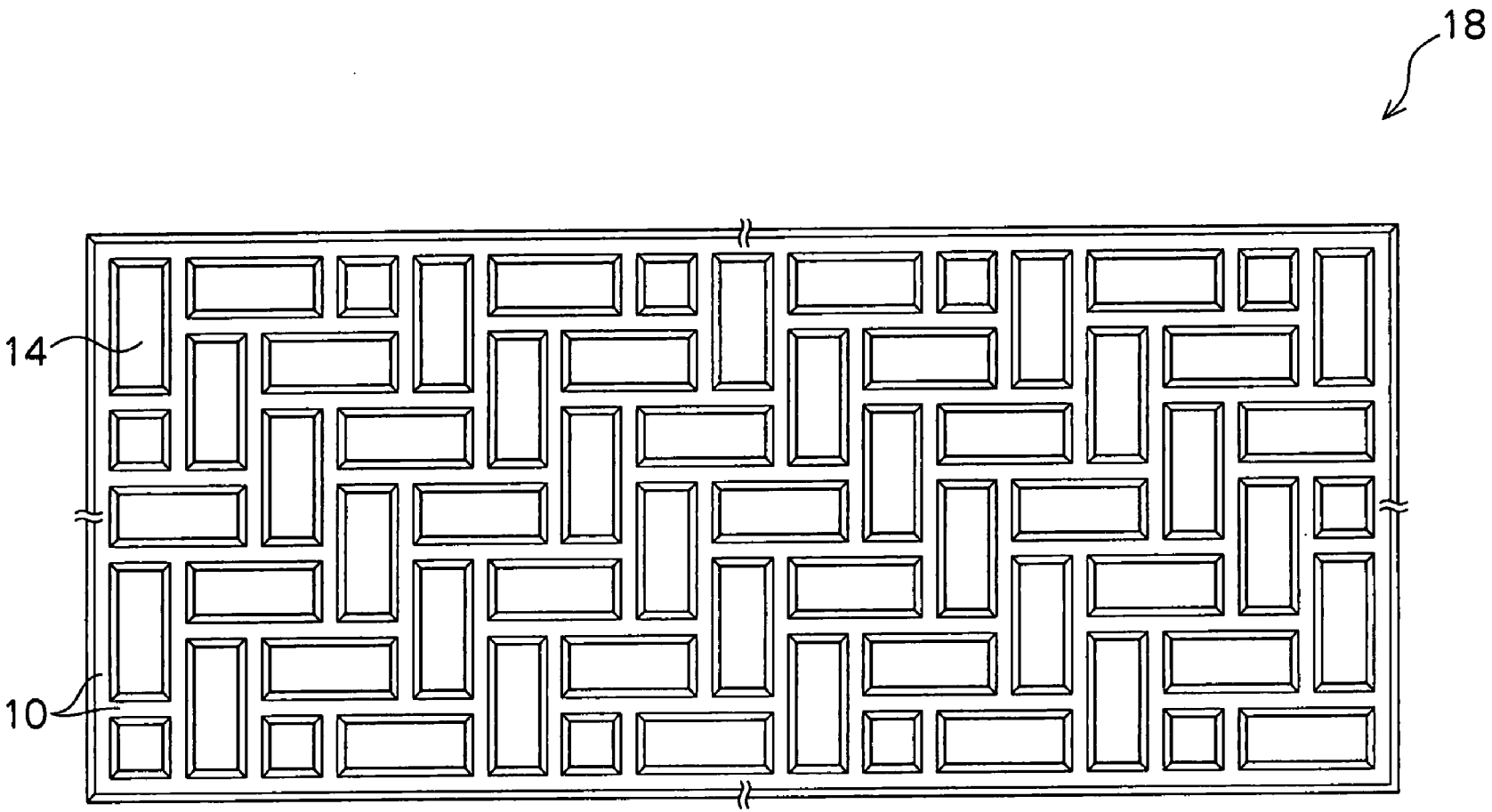
FIG. 7 is a plan view showing a seventh example of a sheet with image display medium ribs of the present invention.
Figure 8:
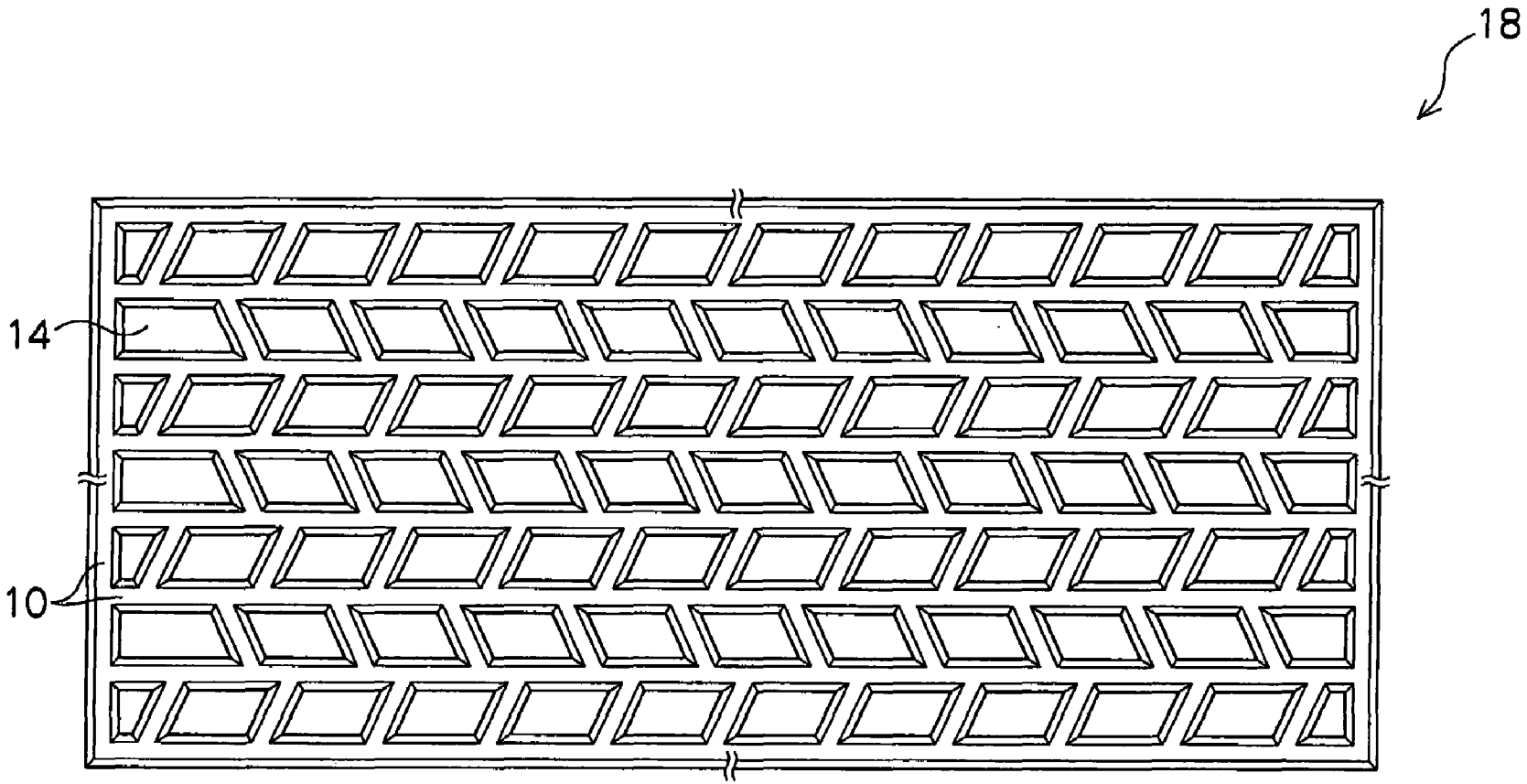
FIG. 8 is a plan view showing an eighth example of a sheet with image display medium ribs of the present invention.
Figure 9:
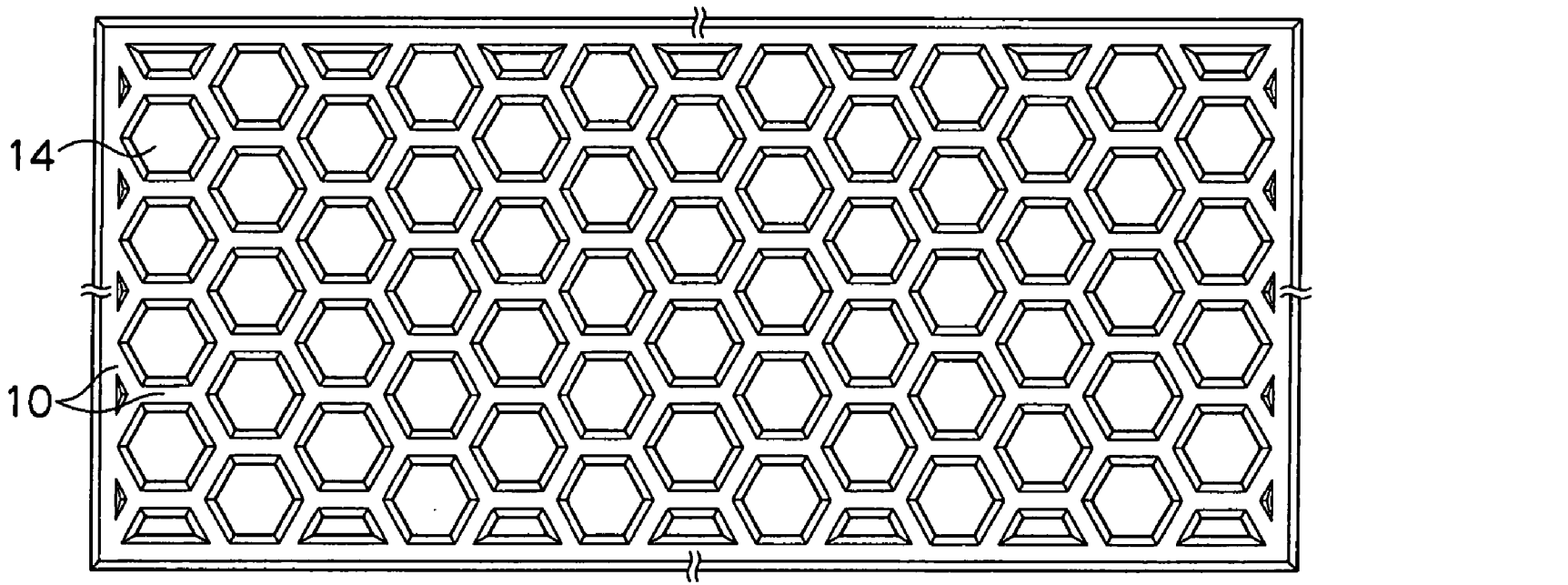
FIG. 9 is a plan view showing a ninth example of a sheet with image display medium ribs of the present invention.
Figure 10:
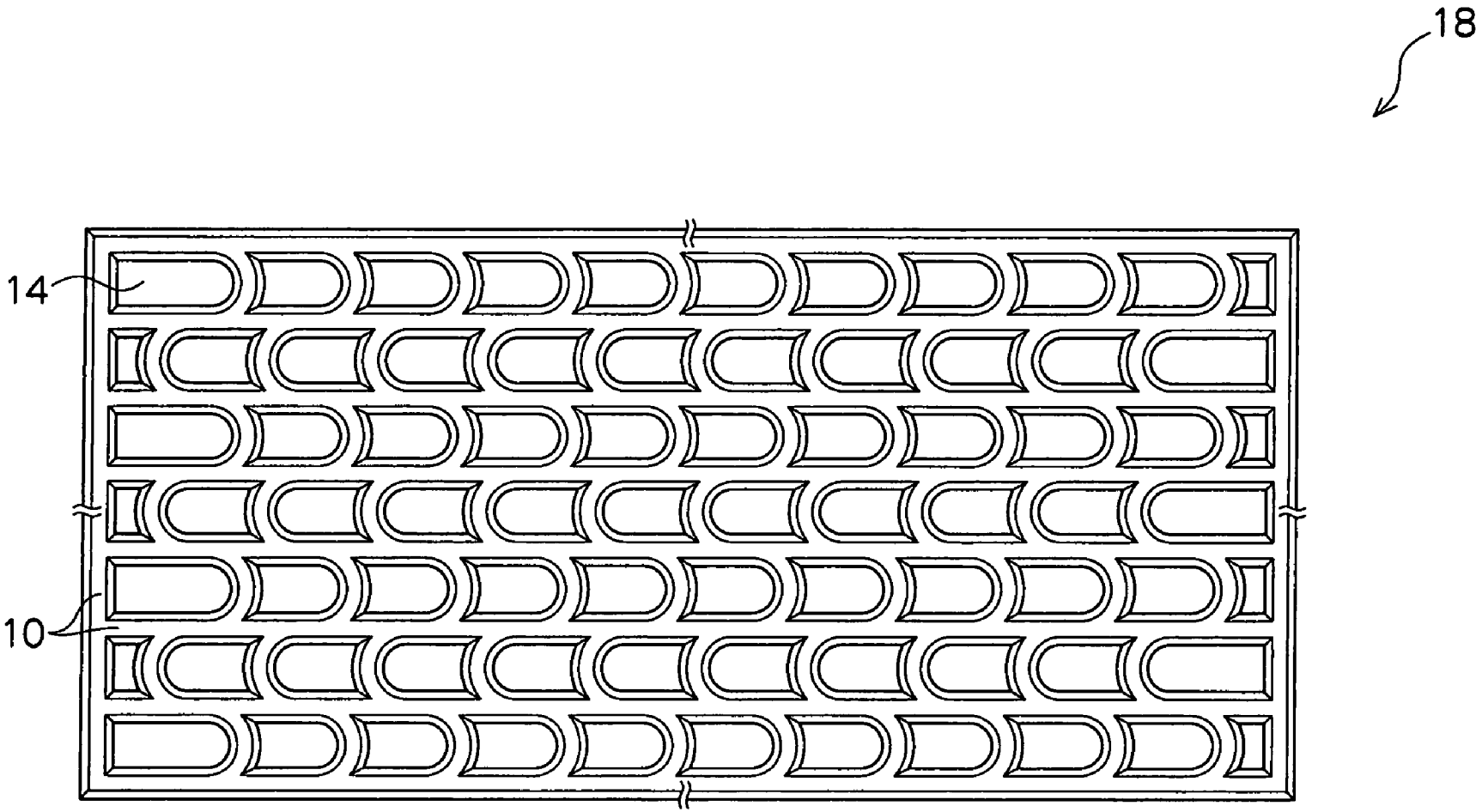
FIG. 10 is a plan view showing a tenth example of a sheet with image display medium ribs of the present invention.
Figure 11:
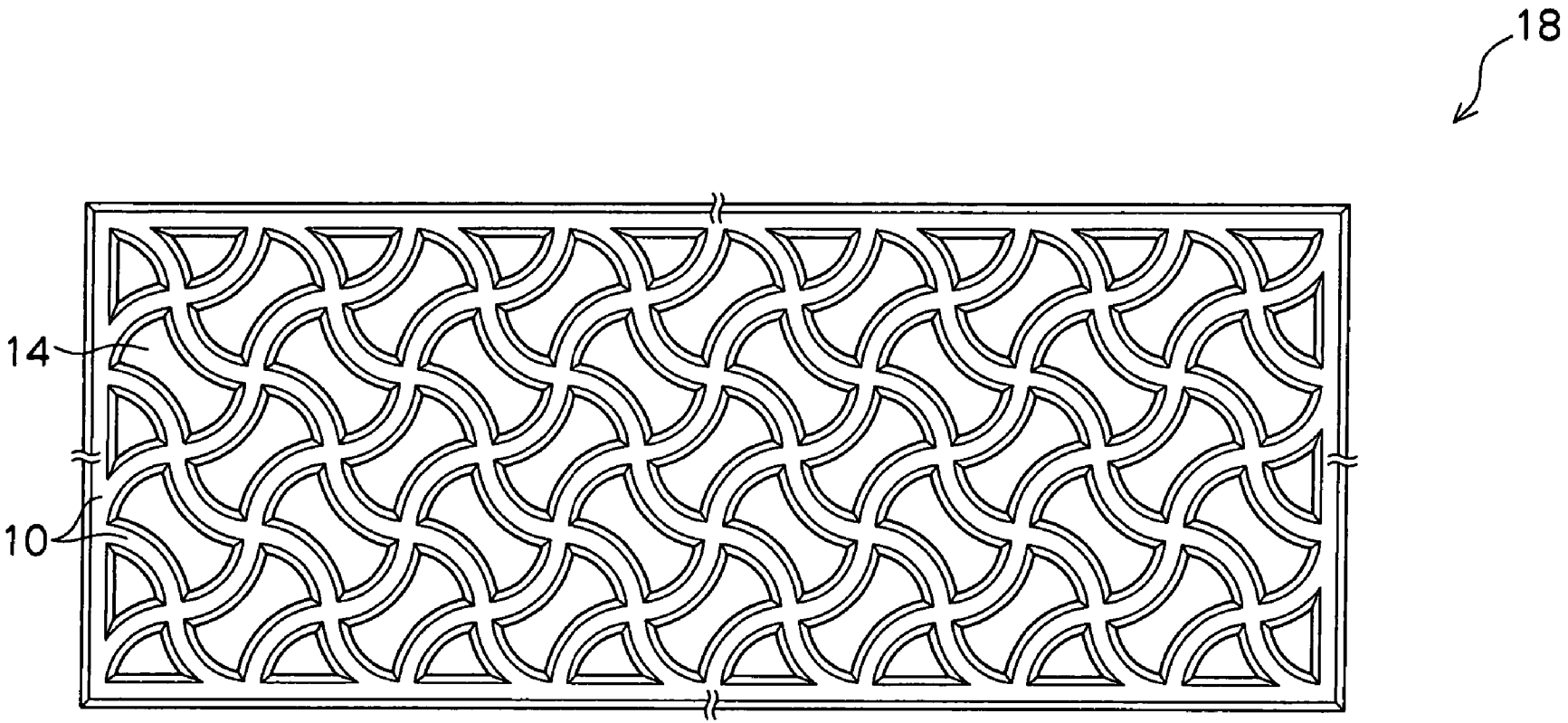
FIG. 11 is a plan view showing an eleventh example of a sheet with image display medium ribs of the present invention.

FIG. 4 shows an example in which the arrangement of cells surrounded by ribs is a lattice pattern of rectangles. FIG. 5 shows an example in which the arrangement of cells surrounded by ribs is a staggered pattern of rectangles. FIG. 6 shows another example in which the arrangement of cells surrounded by ribs is a staggered pattern of rectangles. FIG. 7 shows an example in which the arrangement of cells surrounded by ribs is a herringbone pattern which combines horizontal and vertical rectangles. FIG. 8 shows an example in which the arrangement of cells surrounded by ribs is a staggered array of parallelograms. FIG. 9 shows an example in which the arrangement of cells surrounded by ribs is a honeycomb pattern. FIG. 10 shows an example of an arrangement of cells surrounded by a combination of straight ribs and curved ribs. FIG. 11 shows an example of an arrangement of cells surrounded by a combination of curved ribs.

Color of a ribbed sheet of the present invention is not particularly limited. However, black or colorless transparency is preferable. The definition of colorless transparency here is transmissivity for all light of at least 70%. In the case of black, black contrast of image display is reinforced, and there is no effect on color display image quality. In the case of colorless transparency, in particular with particle-type image display mediums, an open area ratio utilizing reflection can be made larger, which is advantageous. In contrast, with blue, green or the like, color image quality is affected, and the gamut may be adversely affected.

An image display medium may be employed in, for example, a display such as a plasma display panel (PDP), an electroluminescent display element (EL) or the like, or electronic paper which employs an image display material with electrophoreticity, thermal rewritability, electrochromy or the like, or the like. Among these, PDPs, EL displays, and particle driving-type display media are particularly appropriate.

Depending on the respective image display medium of application, known functional layers such as an induction layer, an anti-oxidation layer, a waterproofing layer and the like may be coated at surfaces of the ribbed sheet of the present invention, as appropriate.

Image Display Medium

An image display medium of the present invention may include, for example, a pair of substrates and a ribbed sheet. This pair of substrates is structured by a rear face substrate and a display substrate. The ribbed sheet is sandwiched between the pair of substrates, and includes a base plate portion and ribs. The ribs protrude from the base plate portion and are formed integrally with the base plate portion. The above-described ribbed sheet of the present invention may be applied as the ribbed sheet of this image display medium.

The image display medium of the present invention may be, as mentioned above, a display such as a plasma display panel (PDP), an electroluminescent display element (EL) or the like, or a particle driving-type image display medium such as electronic paper which employs an image display material with electrophoreticity, thermal rewritability, electrochromy or the like, and beside including the above-described ribbed sheet of the present invention, may be any well-known structure.

Specifically, if, for example, stripe-form transparent electrodes are formed on at least one of the pair of substrates (the rear face substrate) and stripe-form transparent electrodes are formed on the other substrate (the display substrate) beforehand, and a luminescent substance is coated onto a surface of the ribbed sheet, a PDP can be provided, and if particles or a particle dispersion are charged into a space between the ribbed sheet and a substrate, a particle driving-type image display medium (electronic paper) can be provided.

Specifically, with a PDP, it is possible to produce the PDP simply, by LIM-molding a ribbed sheet onto a back face substrate at which driving electrodes and addressing electrodes are formed. In particular, because the ribbed sheet of the present invention enables ribs with narrow rib widths, the open area ratio can be made larger and image quality can be raised. Furthermore, when a ribbed sheet with a cell-form arrangement of ribs is employed, unlike stripe-form ribs, a coating area for a fluorescent substance is large. As a result, light emission efficiency is extremely high, and high brightness and low power consumption can be realized. In addition, because the ribs have the same form as pixels, image quality is extremely high.

With an EL display too, it is possible to produce the EL display simply, by LIM-molding a ribbed sheet onto a back face substrate at which driving electrodes are formed. Similarly to the PDP, it is possible to make an open area ratio larger and raise image efficiency, to realize high brightness and low power consumption, and to make image quality extremely high.

With a particle driving-type display medium too, it is possible to produce the particle driving-type display medium simply, by LIM-molding a ribbed sheet onto a back face substrate at which driving electrodes are formed. Similarly to the PDP, it is possible to make an open area ratio larger and raise image quality. In particular, in the case of such a particle driving-type display medium, particles are moved to form an image by voltages applied to the rear face substrate and the display substrate. Therefore, when a ribbed sheet with a cell-form arrangement of ribs is employed, unlike stripe-form ribs, it is possible to provide the two functions of preventing sinkage of the particles when the display medium is left standing and preventing lateral flows between neighboring electrodes.

In an image display medium of the present invention, a transparent substrate is employed for one of the pair of substrates (the display substrate). For the other substrate (the rear face substrate), a transparent substrate or some other substrate is employed. Transparent electrodes may be provided at the transparent substrate(s) and non-transparent electrodes provided at any other substrate.

Specific examples of transparent substrates include glass, glass epoxy, polycarbonate, polyester, polymethyl methacrylate and amorphous polyolefin substrates, and the like. Among these, use of glass and glass epoxy substrates is preferable for the following reason: because water-blocking capabilities thereof are high.

Other specific examples of substrates include metallic plates coated with glass epoxy or an insulator, and the like.

As transparent electrode materials, indium tin oxide (ITO), metallic compounds such as tin oxides, indium oxides and the like, and conductive polymers such as polyaniline and the like, and the like are available. Among these, use of ITO is preferable for the following reasons: because surface resistivity is low and endurance is high. As materials for non-transparent electrodes, metals such as copper, aluminium and the like, carbon and the like, the above-mentioned materials for transparent electrodes, and the like are available.

EXAMPLES

Below, the present invention is specifically described by Examples. The present invention should not be construed to be limited by these Examples.

Example 1

Figure 12B:
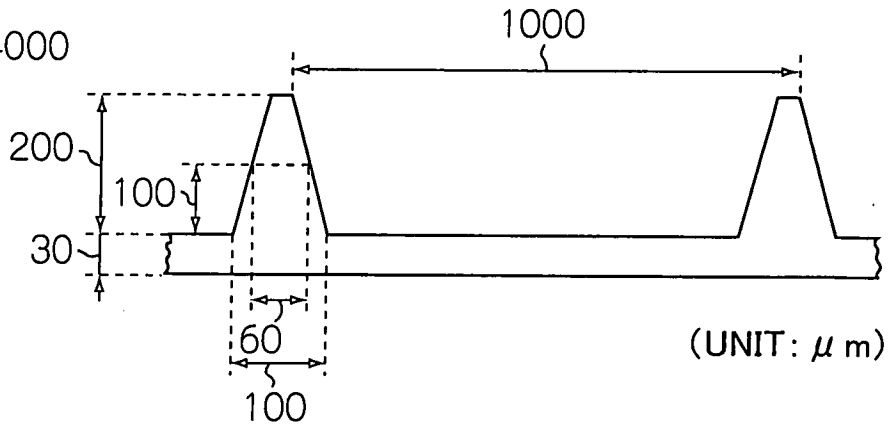
FIG. 12B is a sectional view cut along line 1—1 of FIG. 12A.
Figure 12A:
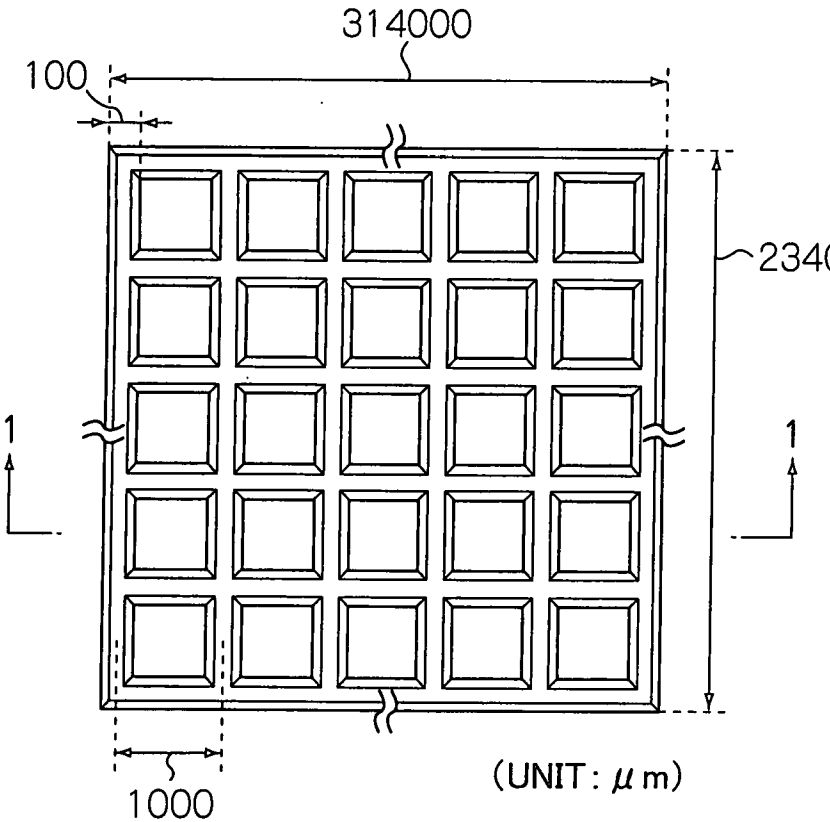
FIG. 12A is a plan view of a sheet with image display medium ribs of Example 1.

A mold is prepared which is machined to a rib height of 200 μm, a rib base width of 100 μm, a rib half-height width of 60 μm with rib side walls sloping in straight lines (i.e., the rib side walls have tapered forms), a rib spacing of 1000 μm and a layer thickness (a layer thickness which is the thickness of the base plate portion) of 30 μm, as with the structure shown in FIGS. 12A and 12B. A plan area of these ribs is 314 by 234 mm. A reinforced glass substrate with a length and width of 320 by 240 mm and a thickness of 0.7 mm, at a surface of which stripe electrodes of ITO are formed with a lines/space density of 900/100 μm, is set on the mold. Using an LIM molding device (LIM-400-INJ, produced by Seijo Seiki Co., Ltd.), a binary liquid epoxy resin (PELNOX MG-151 and PELCURE HY-660, which are produced by Nippon Pelnox Corporation, in a ratio by weight of 100/26), is LIM-molded under conditions with an injection temperature of 25° C. and a mold temperature of 100° C. Separability of an obtained lattice-pattern cell-form arrangement, in which the cell forms have square shapes, is measured as a separation area.

A viscosity of the epoxy resin at 25° C. is measured by an E-type viscometer. A Shore hardness of this epoxy resin at 25° C. after curing is measured by a process complying with ASTM-D-2240. With regard to the cell-form arrangement, rib height, rib width, rib half-height width, rib spacing, and a high-low difference of the ribs are measured with a laser confocal microscope (OLS1100, produced by Olympus Corporation). An image obtained by the laser confocal microscope is subjected to further image analysis, and an open area ratio (area excluding rib peak portions/total area×100) is measured. Color of the ribs is observed visually, and overall light transmissivity is measured with a spectrophotometer (UV4000, produced by Hitachi, Ltd.). Results are shown in Table 1.

Example 2

A cell-form arrangement ribbed sheet is obtained in the same manner as in Example 1 except that the epoxy resin is changed to PELNOX ME-105/PELCURE HY-680, which are produced by Nippon Pelnox Corporation, in a ratio by weight of 100/33. Evaluation is implemented in the same manner as in Example 1. Results are shown in Table 1.

Example 3

A cell-form arrangement ribbed sheet is obtained in the same manner as in Example 1 except that the epoxy resin is changed to PELNOX ME-512/PELCURE HV-512, which are produced by Nippon Pelnox Corporation, in a ratio by weight of 1/1 and conditions are set for an injection temperature of 20° C. and a mold temperature of 100° C. Evaluation is implemented in the same manner as in Example 1. Results are shown in Table 1.

Example 4

A cell-form arrangement ribbed sheet is obtained in the same manner as in Example 1 except that the epoxy resin is changed to a single liquid (DM-330, produced by Asahi Chemical Research Laboratory Co., Ltd.) and conditions are set for an injection temperature of 35° C. and a mold temperature of 100° C. Evaluation is implemented in the same manner as in Example 1. Results are shown in Table 1.

Example 5

Figure 13B:
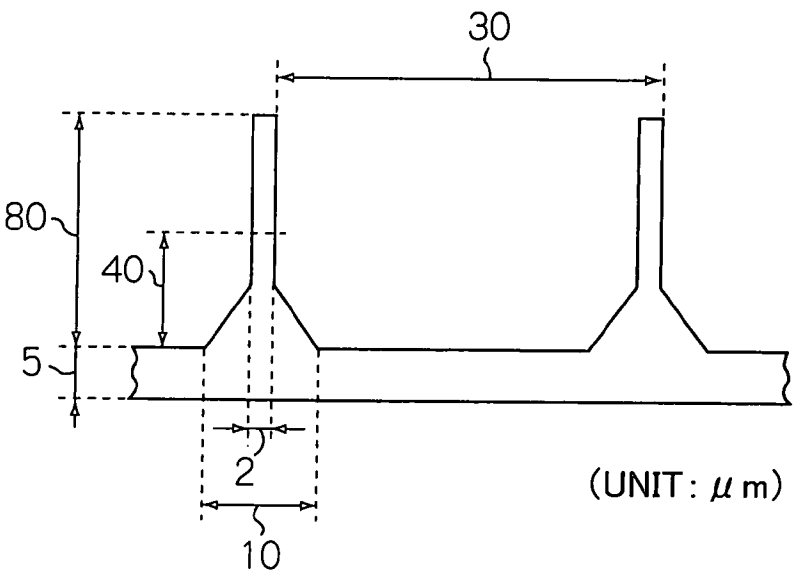
FIG. 13B is a sectional view cut along line 1—1 of FIG. 13A.
Figure 13A:
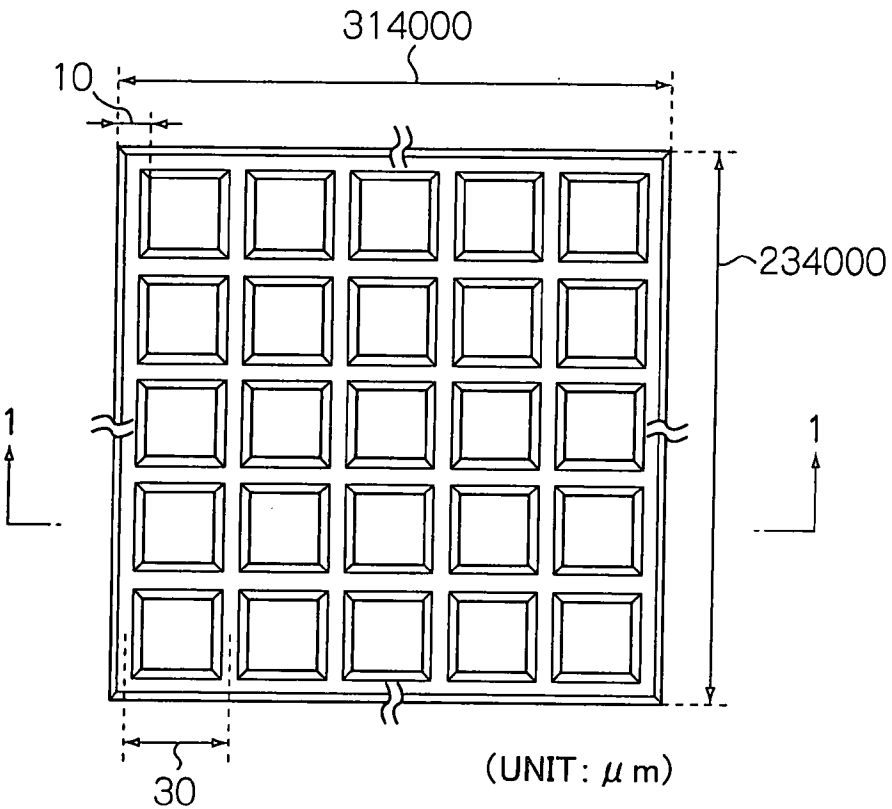
FIG. 13A is a plan view of a sheet with image display medium ribs of Example 5.

A mold is prepared which is machined to a cross-section featuring inflection points, with a rib base width of 10 μm, a rib half-height width of 2 μm, a rib height of 80 μm, a rib spacing of 30 μm and a layer thickness (a layer thickness which is the thickness of the base plate portion) of 5 μm, as with the structure shown in FIGS. 13A and 13B. A plan area of these ribs is 314 by 234 mm. Thereafter, a lattice-pattern cell-form arrangement ribbed sheet, in which the cell forms have square shapes, is obtained in the same manner as in Example 1 except that the ITO stripe electrodes are formed with a lines/space density of 10/10 μm. Evaluation is implemented in the same manner as in Example 1. Results are shown in Table 1.

Example 6

Figure 14B:
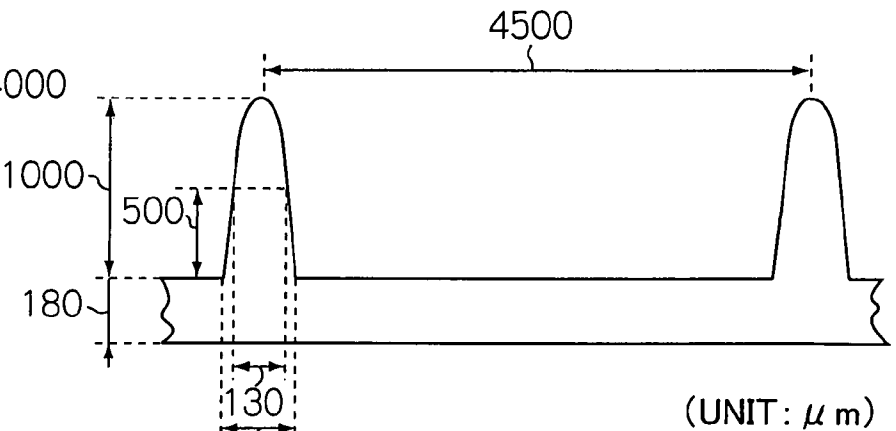
FIG. 14B is a sectional view cut along line 1—1 of FIG. 14A.
Figure 14A:
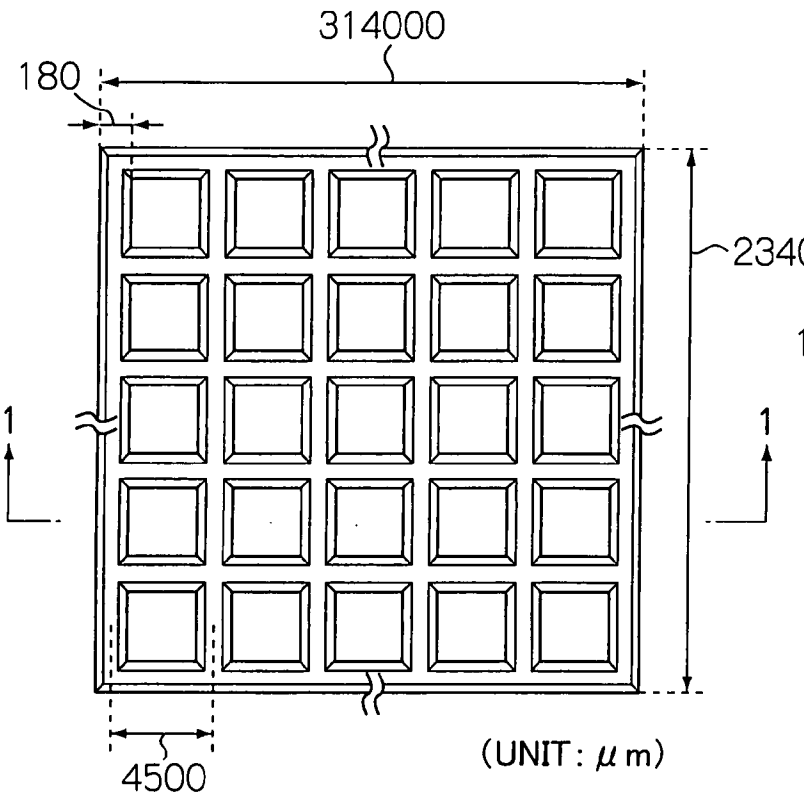
FIG. 14A is a plan view of a sheet with image display medium ribs of Example 6.

A mold is prepared which is machined to a distally curved cross-section, with a rib base width of 180 μm, a rib half-height width of 130 μm, a rib height of 1000 μm, a rib spacing of 4500 μm and a layer thickness (a layer thickness which is the thickness of the base plate portion) of 180 μm, as with the structure shown in FIGS. 14A and 14B. A plan area of these ribs is 314 by 234 mm. Thereafter, a lattice-pattern cell-form arrangement ribbed sheet, in which the cell forms have square shapes, is obtained in the same manner as in Example 1. Evaluation is implemented in the same manner as in Example 1. Results are shown in Table 1.

Example 7

A cell-form arrangement ribbed sheet is obtained in the same manner as in Example 1 except that the substrate is changed to a reinforced glass substrate with a length and width of 320 by 240 mm and a thickness of 0.6 mm. Evaluation is implemented in the same manner as in Example 1. Results are shown in Table 1.

Example 8

A cell-form arrangement ribbed sheet is obtained in the same manner as in Example 1 except that the substrate is changed to a PET film with a length and width of 320 by 240 mm and a thickness of 255 μm. Evaluation is implemented in the same manner as in Example 1. Results are shown in Table 1.

Example 9

Figure 15B:
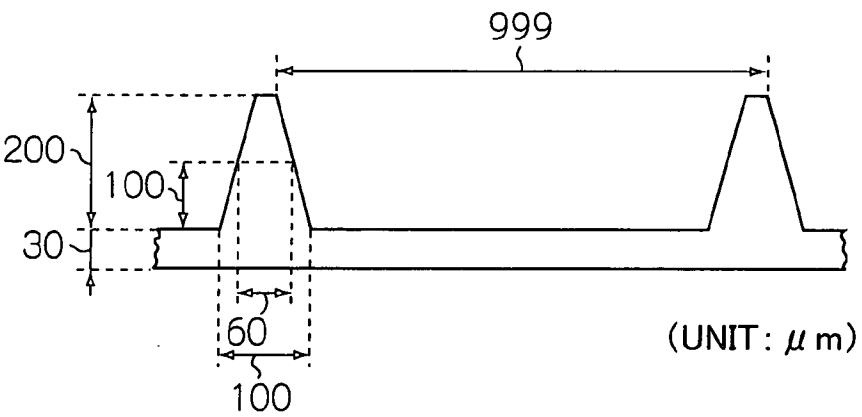
FIG. 15B is a sectional view cut along line 1—1 of FIG. 15A.
Figure 15A:
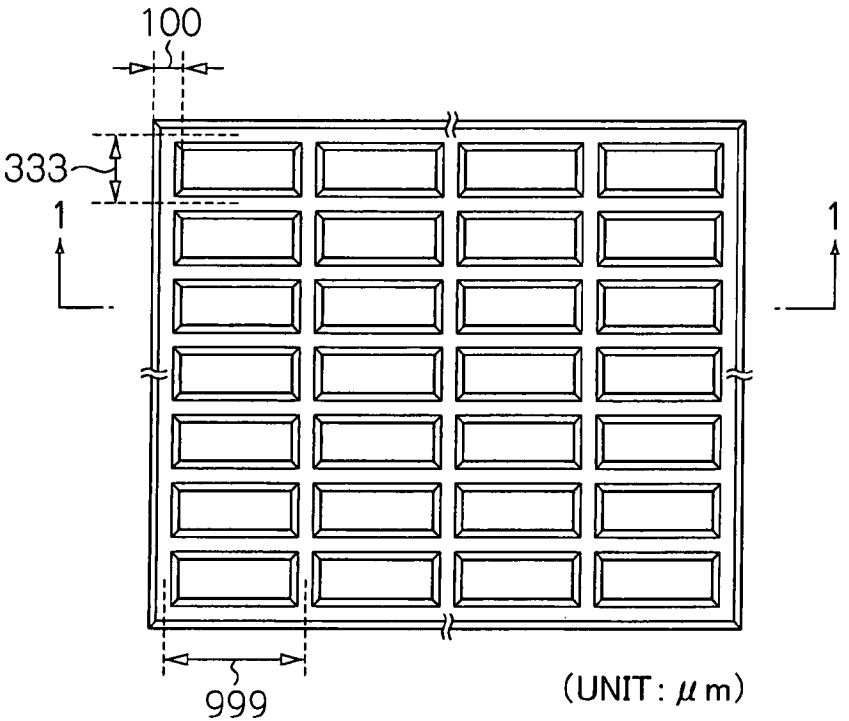
FIG. 15A is a plan view of a sheet with image display medium ribs of Example 9.

A lattice-pattern cell-form arrangement ribbed sheet in which the cell-forms have rectangular shapes is obtained in the same manner as in Example 1, except that the mold that is prepared is machined to rib side walls which slope in straight lines with a rib height of 200 μm, a rib base width of 100 μm, a rib half-height width of 60 μm, a rib spacing which differs between a long axis and a short axis, being 999 μm along the long axis side and 333 μm along the short axis side, and a layer thickness (a layer thickness which is the thickness of the base plate portion) of 30 μm, as with the structure shown in FIGS. 15A and 15B. Evaluation is implemented in the same manner as in Example 1. Results are shown in Table 1.

Example 10

Figure 16B:
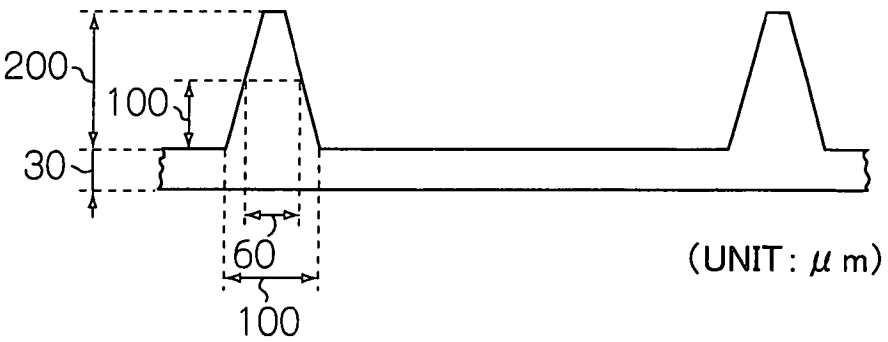
FIG. 16B is a sectional view cut along line 1—1 of FIG. 16A.
Figure 16A:
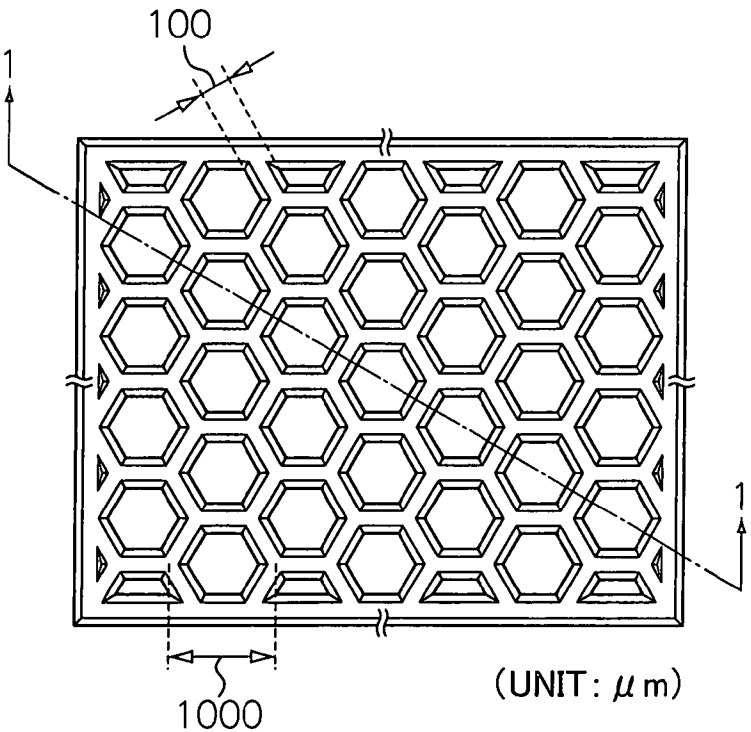
FIG. 16A is a plan view of a sheet with image display medium ribs of Example 10.

A cell-form arrangement ribbed sheet in which the cell-form arrangement has a honeycomb pattern is obtained in the same manner as in Example 1, except that the mold that is prepared is machined to rib side walls which slope in straight lines with a rib height of 200 μm, a rib base width of 100 μm, a rib half-height width of 60 μm, a rib spacing, which is defined from corner to corner of the hexagon shapes, of 1000 μm, and a layer thickness (a layer thickness which is the thickness of the base plate portion) of 30 μm, as with the structure shown in FIGS. 16A and 16B. Evaluation is implemented in the same manner as in Example 1. Results are shown in Table 1.

Comparative Example 1

A photo mask is prepared such that rib height, rib base width and rib spacing will be the same as in Example 1. On a reinforced glass substrate similar to that of Example 1, cell-form arrangement ribs formed of glass paste are obtained on the substrate by a photolithography process using a dry film. Evaluation is implemented for the cell-form arrangement ribs that are obtained in the same manner as in Example 1. Results are shown in Table 1.

Comparative Example 2

A screen plate is prepared such that rib base width and rib spacing will be the same as in Example 1. Printing ink (a heat-curable epoxy resin: DM-330, produced by Asahi Chemical Synthetic Co., Ltd.) is laminated to a total of 12 layers, until the rib height is similar to that in Example 1, by a screen printer (MT1100TCV, produced by Microtek Inc.) on a reinforced glass substrate similar to that of Example 1. Thus, cell-form arrangement ribs are obtained on the substrate. Evaluation is implemented for the cell-form arrangement ribs that are obtained in the same manner as in Example 1. Results are shown in Table 1.

TABLE 1

| | Form of ribs | | | | | | | | | | |
|---|---|---|---|---|---|---|---|---|---|---|---|
| Item | Rib base width (μm) | Rib half-height width (μm) | Rib height (μm) | Rib pitch (μm) | Rib high-low difference (μm) | Releasability (%) | Viscosity (Pa · s) | Shore Hardness (D) | Open area ratio (%) | Color | Overall light transmissivity (%) |
| Example 1 | 100 | 60 | 200 | 1000 | 4 | 100 | 0.2 | 25 | 88 | Transparent | 80 |
| Example 2 | 99 | 58 | 198 | 1000 | 3 | 100 | 1.5 | 85 | 89 | Transparent | 81 |
| Example 3 | 99 | 59 | 199 | 999 | 5 | 100 | 0.5 | 85 | 88 | Transparent | 80 |
| Example 4 | 98 | 57 | 198 | 999 | 4 | 100 | 1.4 | 95 | 88 | Black | — |
| Example 5 | 10 | 2 | 79 | 30 | 4 | 100 | 0.2 | 25 | 92 | Transparent | 80 |
| Example 6 | 180 | 129 | 998 | 4500 | 4 | 100 | 0.2 | 25 | 93 | Transparent | 80 |
| Example 7 | 100 | 60 | 200 | 1000 | 4 | 100 | 0.2 | 25 | 88 | Transparent | 80 |
| Example 8 | 102 | 60 | 198 | 1000 | 5 | 100 | 0.2 | 25 | 87 | Transparent | 80 |
| Example 9 | 99 | 59 | 197 | 998/333 | 5 | 100 | 0.2 | 25 | 92 | Transparent | 81 |
| Example 10 | 108 | 61 | 197 | 997 | 6 | 100 | 0.2 | 25 | 87 | Transparent | 80 |
| Comparative Example 1 | 160 | 140 | 198 | 999 | 15 | — | — | 4 | 69 | Blue | 17 |
| Comparative Example 2 | 240 | 200 | 189 | 992 | 30 | — | — | 95 | 58 | Black | — |

As shown in Table 1, because the cell-form arrangement ribbed sheets of the present invention, of Examples 1 to 10, are LIM-molded using heat-curable epoxy resins, ribs with cell-form arrangements and narrow rib widths can be provided while being free of defects. Furthermore, because the ratios of rib half-height width to rib base width are not more than 0.7, even though the epoxy resins, whose inherent releasability is poor, are finely formed, the cell-form arrangement ribs can be provided with excellent releasability and small high-low differences. Further still, because the rib base widths are narrow, being 200 μm at most, and the ratios of rib half-height width to rib base width are small, being not more than 0.7, the open area ratios are extremely high.

In contrast, with the cell-form arrangement ribbed sheet illustrated in Comparative Example 1, from beyond the scope of the present invention, because the ribs are formed of glass paste by photolithography, the ratio of the rib half-height width to the base width exceeds 0.7, this structure is very broad and stocky, and the open area ratio is low. Moreover, because the cell-form arrangement ribs illustrated in Comparative Example 2, from beyond the scope of the present invention, are formed by implementing screen printing using printing ink, the rib base width exceeds 200 μm, the ratio of the rib half-height width to the base width again exceeds 0.7, and this structure is very broad and stocky. Accordingly, the open area ratio is small, and because the number of lamination cycles is large, the high-low difference of the ribs is large.

Example 11

A rib face of a substrate on which the cell-form arrangement ribbed sheet provided for Example 1 has been formed is coated with BAM ($BaMgAl_{10}O_{17}$: $Eu^{2+}$), which is a blue fluorescent substance, using a screen printing apparatus (MT550-TVC, produced by Microtek Inc.), leaving rib peaks uncoated.

Then, using a laminator (KIMOTECT, produced by Kimoto Tech, Inc.), a glass substrate is contacted and adhered at this rib side under conditions of a roller temperature of 180° C. and a feed rate of 20 mm/sec. This glass substrate is provided with transparent electrodes made of ITO in a direction perpendicular to electrodes of the rib side substrate with a lines/space density of 900/100 μm, a bus electrode and a magnesium oxide protection layer. Thus, a display medium test item of a single color is fabricated.

Voltages of ±100 V are applied to the electrodes of the whole surface of this display medium, the BAM is caused to emit light, and the brightness of the display medium is measured. Further, the stripe electrodes are set alternately on and off, an image in which light-emitting pixels and non-light-emitting pixels alternate is formed, and a difference in brightness between light-emitting portions and non-light-emitting portions is measured. Results are shown in Table 2.

Examples 12 to 20

For Examples 12 to 20, single-color display medium test items are fabricated in the same manner as in Example 11, except-that the cell-form arrangement ribbed sheets formed for Examples 2 to 10, respectively, are employed. Evaluations are implemented in the same manner as in Example 11. Results are shown in Table 2.

Comparative Example 3

A photomask is prepared so as to form a stripe-form arrangement with rib height 100 μm, rib base width 100 μm and rib pitch 1000 μm. Thereafter, similarly to Comparative Example 1, stripe-form ribs are provided on a substrate in a manner similar to that employed for a PDP or the like.

A single-color display medium test item is fabricated in the same manner as in Example 11, except that this substrate on which the stripe-form ribs are formed is utilized. Evaluations are implemented in the same manner as in Example 11. Results are shown in Table 2.

Comparative Example 4

A photomask is prepared so as to form a stripe-form arrangement with rib height 100 μm, rib base width 100 μm and rib pitch 1000 μm. Thereafter, similarly to Comparative Example 2, stripe-form ribs are provided on a substrate in a manner similar to that employed for a PDP or the like.

A single-color display medium test item is fabricated in the same manner as in Example 11, except that this substrate on which the stripe-form ribs are formed is utilized. Evaluations are implemented in the same manner as in Example 11. Results are shown in Table 2.

TABLE 2

| Item | Brightness ($cd/m^2$) | Difference in brightness ($cd/cm^2$) |
|---|---|---|
| Example 11 | 580 | 540 |
| Example 12 | 570 | 520 |
| Example 13 | 570 | 520 |
| Example 14 | 560 | 520 |
| Example 15 | 630 | 600 |
| Example 16 | 640 | 620 |
| Example 17 | 580 | 530 |
| Example 18 | 560 | 530 |
| Example 19 | 590 | 550 |
| Example 20 | 580 | 530 |
| Comparative Example 3 | 320 | 180 |
| Comparative Example 4 | 280 | 90 |

As shown in Table 2, with the image display mediums of the present invention, of Examples 11 to 20, because the rib widths are narrow even in cell-form arrangements, fluorescent substance coating areas are large, open area ratios are large, and brightnesses are very high. Further, because these mediums have cell-form arrangement ribs, the pixels are completely separated by the ribs. As a result, the differences in brightness between light-emitting portions and non-light-emitting portions are large, and images can be displayed with extremely high resolution and high image quality.

In contrast, with the image display mediums outside the present invention, of Comparative Examples 3 and 4, because the ribs are formed in stripe-form arrangements, fluorescent substance coating areas are small. Therefore, brightnesses are low and light leakage occurs, particularly in the directions in which ribs are absent. The differences in brightness between light-emitting portions and non-light-emitting portions are small, and displays can only be implemented with low resolutions and image qualities.

Example 21

Next, an Example of a particle driving-type display medium will be illustrated. First, white particles and black particles are fabricated by the following process.

Production of White Microparticles 53 parts by weight of methacrylic acid cyclohexyl, 45 parts by weight of titanium oxide (TIPAQUE CR63, produced by Ishihara Sangyo Kaisha, Ltd.), 2 parts by weight of a charging control agent (COPY CHARGE PSY VP2038, produced by Clearland Japan), and 5 parts by weight of cyclohexane are ground for 20 minutes in a ball mill, with 10 mm-diameter zirconia beads as a medium. Thus, dispersion fluid A is obtained. Then, 40 parts by weight of calcium carbonate and 60 parts by weight of distilled water are similarly ground in a ball mill, and dispersion fluid B is produced. 43 parts by weight of a 2% CELOGEN aqueous solution and 500 parts by weight of water with a table salt content of 20% are also mixed, de-aerated for 10 minutes in an ultrasonic washer and then stirred in an emulsifier, and mixture fluid C is produced. Then, 350 parts by weight of the dispersion fluid A, 10 parts by weight of divinyl benzene and 3.5 parts by weight of bis-azo isobutyl nitryl are poured into a one-liter beaker, stirred with a THREE-ONE MOTOR and, after mixing, de-aerated for 10 minutes with an ultrasonic washer. Thus, a mixture fluid D is obtained. 1 part by weight of this mixture fluid D and 1 part by weight of the mixture fluid C are together put into an emulsifier and emulsified. This emulsion is put into an odor bottle, a silicone bung is inserted, the emulsion is de-aerated by low pressure with an injector, and nitrogen gas is charged therein. Next, the emulsion is caused to react for 10 minutes at 60° C., and a particle dispersion fluid is produced. After cooling, using a freeze dryer, cyclohexane is eliminated from this dispersion by conditions of −35° C. and 0.1 Pa for two days. Particles that are obtained are dispersed in ion-substituted water, the calcium carbonate is decomposed with dilute hydrochloric acid, and the particles are filtered. Thereafter, the particles are washed with plentiful amounts of distilled water, and passed through nylon sieves with mesh sizes of 20 μm and 25 μm to control particle size. The particles are dried, and white particles with an average particle diameter of 23 μm are obtained.

Production of Black Microparticles 67 parts by weight of a styrene monomer, 10 parts by weight of carbon black (CF9, produced by Mitsubishi Chemical Corporation) and five parts by weight of cyclohexane are ground for 20 minutes in a ball mill, with 10 mm-diameter zirconia beads as a medium. Thereafter, in the same manner as the white particles, black particles with an average diameter of 23 μm are obtained.

Fabrication of Image Display Medium

At the rib side of a substrate at which the cell-form arrangement ribbed sheet provided in Example 1 is formed, the above-described white particles and black particles are mixed in a ratio by weight of 3:2, respectively, and 2 mg of the mixed particles are uniformly loaded using a urethane blade. Then, using a laminator (KIMOTECT, produced by Kimoto Tech, Inc.), a glass substrate is contacted and adhered at this rib side under conditions of a roller temperature of 180° C. and a feed rate of 20 mm/sec. This glass substrate is provided with transparent electrodes made of ITO in a direction perpendicular to electrodes of the rib side substrate with a lines/space density of 900/100 μm and a polycarbonate induction layer. Thus, a particle driving-type display medium is fabricated.

Respective voltages of +140 volts and −140 volts are alternately applied to the ITO electrodes at both sides of this particle driving-type display medium, and white display and black display are implemented. Respective densities of the white display and black display are measured with an X-RITE, and a contrast (black density minus white density) is calculated. Results are shown in Table 3.

This particle driving-type display medium is placed upright, and black display and white display similar to the above are respectively repeated 10,000 times. After this, the contrast is measured by the same process as above. Further, a black Letter "X" is displayed on a white background, and whether or not there is blurring in the display is evaluated visually. Results are shown in Table 3.

Examples 22 to 30

Particle driving-type display mediums are produced in the same manner as for Example 21, except that instead of the substrate at which the cell-form arrangement rib sheet provided for Example 1 is formed, substrates at which the cell-form arrangement rib sheets provided for Examples 2 to 10, respectively, are formed are utilized. Evaluations are implemented for these particle driving-type display mediums in the same manner as for Example 21. Results are shown in Table 3.

Comparative Examples 5 and 6

Particle driving-type display mediums are produced in the same manner as for Example 21, except that instead of the substrate at which the cell-form arrangement rib sheet provided for Example 1 is formed, substrates at which the stripe-form ribs provided for Comparative Examples 3 and 4, respectively, are formed are utilized. These particle driving-type display mediums are placed upright such that the striped ribs are perpendicular to the ground, and evaluations are implemented in the same manner as for Example 21. Results are shown in Table 3.

Comparative Examples 7 and 8

The particle driving-type display mediums of Comparative Examples 5 and 6 are placed upright such that the striped ribs are in line with the ground, and evaluations are implemented in the same manner as for Example 21. Results are shown in Table 3.

TABLE 3

| Item | Initial contrast (—) | Contrast after 10,000 cycles (—) | Image blurring |
|---|---|---|---|
| Example 21 | 1.20 | 1.20 | No |
| Example 22 | 1.18 | 1.18 | No |
| Example 23 | 1.19 | 1.19 | No |
| Example 24 | 1.10 | 1.09 | No |
| Example 25 | 1.24 | 1.24 | No |
| Example 26 | 1.30 | 1.30 | No |
| Example 27 | 1.18 | 1.18 | No |
| Example 28 | 1.16 | 1.15 | No |
| Example 29 | 1.25 | 1.24 | No |
| Example 30 | 1.18 | 1.16 | No |
| Comparative Example 5 | 0.78 | 0.45 | Yes |
| Comparative Example 6 | 0.74 | 0.42 | Yes |
| Comparative Example 7 | 0.78 | 0.68 | Yes |
| Comparative Example 8 | 0.72 | 0.40 | Yes |

As shown in Table 3, with the particle driving-type display mediums that utilize cell-form arrangement ribbed sheets of the present invention, which are illustrated in Examples 21 to 30, because the rib widths are narrow even with the cell-form arrangements, open area ratios are high and the initial contrasts are very high. Furthermore, because the ribs have the cell-form arrangements, even when images are displayed repeatedly, there is no particle sinkage or flow in horizontal directions, high contrasts are maintained, and image blurring does not arise.

In contrast, with the particle driving-type image display mediums outside the scope of the present invention that are illustrated in Comparative Examples 5 and 6, because the ribs have stripe forms, even initial contrast is low, and because the ribs are not disposed in a direction parallel to the ground, when image display is repeated, sinkage of the particles occurs, contrast is lowered and image blurring arises. Further, with the particle driving-type image display medium outside the scope of the present invention that is illustrated in Comparative Example 7, even initial contrast is low. Because the ribs are disposed in a direction parallel to the ground, sinkage of the particles does not occur even when image display is repeated. However, because the ribs are not disposed in a direction perpendicular to the ground, lateral flow of the particle occurs, contrast is lowered and image blurring arises. With the particle driving-type image display medium outside the scope of the present invention that is illustrated in Comparative Example 8, even initial contrast is low. The ribs are disposed in a direction parallel to the ground, but because the high-low difference is large, the particles can slip past the ribs and particle sinkage occurs, and lateral flow of the particles also occurs. Thus, contrast is lowered and image blurring arises.

Comparative Examples 9 and 10

Image display mediums are respectively produced in the same manner as for Example 21, but utilizing substrates at which the cell-form arrangement ribs provided for Comparative Examples 1 and 2 are formed. Evaluations are implemented in the same manner as for Example 21. Results are shown in Table 4.

TABLE 4

| Item | Initial contrast (—) | Contrast after 10,000 cycles (—) | Image blurring |
|---|---|---|---|
| Comparative Example 9 | 0.75 | 0.65 | Yes |
| Comparative Example 10 | 0.82 | 0.70 | Yes |

As shown in Table 4, with the image display mediums outside the scope of the present invention that are illustrated in Comparative Examples 9 and 10, because the rib widths are broad, the open area ratios are low, and excellent results can not be obtained.

Accordingly, from the Examples, it can be seen that by LIM molding of thermal epoxy resins, whose releasability is conventionally poor, ribbed sheets in which rib base widths are narrow, at 200 μm or less, and ratios between rib half-height widths and the rib base widths are small, at 0.7 or less, can be produced. Hence, open area ratios are extremely large, brightness when the ribbed sheets are employed in luminescent substance/fluorescent substance coating-type image display mediums can be extremely high, and a difference in brightness between display portions and non-display portions can be made larger, and thus higher image quality can be provided. Further, high contrast can be provided when the ribbed sheets are utilized in particle driving-type display mediums. Further still, because the ribbed sheets have structures in which the rib base widths are at most 200 μm and the ratios of the rib half-height widths to the rib base widths are at most 0.7, that is, because the ribbed sheets are structured similarly to resin inflow portions of a mold by the use of LIM molding, releasability of the heat-curable epoxy resin from the mold is improved, and it is possible to mold even very fine structures. Further again, it can be seen that when the rib base widths are 5 μm or more, a mechanical strength that can withstand practical use can be realized.

What is claimed is:

1. Ribs for an image display device, which are retained between a pair of substrates, wherein the ribs comprise epoxy resin and are integrally formed with a base portion of the image display device by liquid injection molding including the use of heat-curable epoxy resin to form a cell-form arrangement of the ribs, wherein a height of the ribs is at least 50 μm and at most 1000 μm, a spacing of the ribs is at least 20 μm and at most 5000 μm, and a thickness of a base plate portion of the sheet is at least 3 μm and at most 200 μm.

2. The image display device ribs of claim 1, wherein a base width of the ribs is at least 5 μm and at most 200 μm and a ratio of a half-height width of the ribs to the base width of the ribs is at least 0.1 and at most 0.7.

3. The image display device ribs of claim 1, wherein a viscosity at 25° C. of the heat-curable epoxy resin before curing is at least 0.1 Pa·s and at most 100 Pa·s.

4. The image display device ribs of claim 1, wherein a Shore D hardness at 25° C. of the heat-curable epoxy resin after curing is at least 1 and at most 100.

5. The image display device ribs of claim 1, comprising coloration which includes at least one of black and colorless transparency with an overall light transmissivity of at least 70%.

6. The image display device ribs of claim 1, wherein conditions of the liquid injection molding process comprise an injection temperature of at most 40° C. and a mold temperature of at most 150° C.

7. The image display device ribs of claim 1, wherein the ribs are formed so as to form a lattice pattern.

8. An image display device comprising:

a pair of substrates; and ribs retained between the pair of substrates, wherein the ribs comprise epoxy resin and are integrally formed with a base portion of the image display device by liquid injection molding including the use of heat-curable epoxy resin to form a cell-form arrangement of the ribs, wherein a height of the ribs is at least 50 μm and at most 1000 μm, a spacing of the ribs is at least 20 μm and at most 5000 μm, and a thickness of a base plate portion of the sheet is at least 3 μm and at most 200 μm.

9. The image display device of claim 8, wherein a base width of the ribs is at least 5 μm and at most 200 μm and a ratio of a half-height width of the ribs to the base width of the ribs is at least 0.1 and at most 0.7.

10. The image display device of claim 8, wherein a viscosity at 25° C. of the heat-curable epoxy resin before curing is at least 0.1 Pa·s and at most 100 Pa·s.

11. The image display device of claim 8, wherein a Shore D hardness at 25° C. of the heat-curable epoxy resin after curing is at least 1 and at most 100.

12. The image display device of claim 8, comprising coloration of the ribs which includes at least one of black and colorless transparency with an overall light transmissivity of at least 70%.

13. The image display device of claim 8, wherein conditions of the liquid injection molding process comprise an injection temperature of at most 40° C. and a mold temperature of at most 150° C.

14. The image display device of claim 8, wherein the image display device is a luminescent substance or fluorescent substance coating-image display device, in which at least one of a luminescent substance and a fluorescent substance is coated on a surface at which the ribs are disposed.

15. The image display device of claim 8, wherein the image display device is a particle driving image display device, in which particles for image display are charged between the pair of substrates.

16. The image display device of claim 8, wherein the ribs are formed so as to form a lattice pattern.

* * * * *